US006193458B1

(12) United States Patent
Marsh

(10) Patent No.: US 6,193,458 B1
(45) Date of Patent: Feb. 27, 2001

(54) SYSTEM FOR AND METHOD OF BINDING AND TRIMMING A PERFECT BOUND BOOK

(76) Inventor: Jeffrey D. Marsh, 7 Country Rd., Foristell, MO (US) 63348

( * ) Notice: Subject to any disclaimer, the term of this patent is extended or adjusted under 35 U.S.C. 154(b) by 0 days.

(21) Appl. No.: 09/301,918

(22) Filed: Apr. 29, 1999

(51) Int. Cl.[7] ..... B42C 11/02; B26D 5/42

(52) U.S. Cl. ..... 412/1; 412/4; 412/8; 412/19; 83/934; 83/733

(58) Field of Search ..... 412/32, 4, 16, 412/19, 9, 8, 33; 407/42; 83/934, 733

(56) References Cited

U.S. PATENT DOCUMENTS

| | | | | |
|---|---|---|---|---|
| 1,003,679 | * | 9/1911 | Welch . | |
| 1,076,726 | * | 10/1913 | Welch . | |
| 1,088,573 | * | 2/1914 | Heldman . | |
| 1,635,165 | * | 7/1927 | Adamsky . | |
| 1,704,454 | * | 3/1929 | Ackley . | |
| 1,757,623 | * | 5/1930 | Frazier . | |
| 2,895,148 | * | 7/1959 | Hildmann | 412/37 |
| 3,532,363 | | 10/1970 | Abildgaard et al. . | |
| 3,570,350 | | 3/1971 | Fogg . | |
| 3,575,501 | | 4/1971 | Rosenberg . | |
| 3,633,727 | * | 1/1972 | Brenner . | |
| 3,797,362 | * | 3/1974 | Heckman | 83/925 |
| 3,888,150 | | 6/1975 | Stroud et al. . | |
| 3,905,531 | * | 9/1975 | Aspinwall | 83/925 |
| 3,925,126 | | 12/1975 | Leatherman et al. . | |
| 3,925,926 | | 12/1975 | Shigeo . | |
| 3,956,053 | | 5/1976 | Staats . | |
| 3,957,287 | | 5/1976 | Hall et al. . | |
| 3,973,787 | | 8/1976 | Stats et al. . | |
| 4,075,726 | | 2/1978 | Korsgaard . | |
| 4,149,288 | | 4/1979 | Sendor et al. . | |
| 4,184,218 | | 1/1980 | Hawkes . | |
| 4,289,330 | | 9/1981 | Wiermanski . | |
| 4,296,294 | | 10/1981 | Beckert et al. . | |
| 4,367,061 | | 1/1983 | Wiholm . | |
| 4,420,282 | | 12/1983 | Axelrod . | |
| 4,436,469 | * | 3/1984 | Kelly | 412/16 |
| 4,484,501 | * | 11/1984 | Ramcke | 412/16 |
| 4,496,617 | | 1/1985 | Parker . | |
| 4,507,037 | * | 3/1985 | Fenimore | 412/11 |
| 4,518,157 | * | 5/1985 | Stobb | 83/733 |
| 4,606,387 | * | 8/1986 | Weislogel et al. | 83/733 |
| 4,715,758 | | 12/1987 | Stobb . | |
| 4,863,191 | | 9/1989 | Termanis . | |
| 4,922,773 | * | 5/1990 | Ito | 83/76.6 |
| 4,923,351 | | 5/1990 | Nishikawa . | |

(List continued on next page.)

FOREIGN PATENT DOCUMENTS 0390734 8/1990 (EP) .

OTHER PUBLICATIONS

Challenge DocuTrim, The Challenge Machinery Company, 1995, 4 pages, ADV–032C/0396/2.5M/CSP/960026.

*Primary Examiner*—Henry Tsai
*Assistant Examiner*—Alisa L. Thurston
(74) *Attorney, Agent, or Firm*—Polster, Lieder, Woodruff &Lucchesi, L.C.

(57) ABSTRACT

A binder/trimmer is disclosed in which a book block is placed in a carriage, jogged to align the pages, and then transported to a milling station in which the spine of the book block is milled to roughen the spine, then to an adhesive application station at which a suitable adhesive is applied to the spine, and thence to a binding station at which the spine of the book is brought into engagement with the center portion of a cover and at which a binding clamp forces the cover against the outer faces of the book block proximate the spine, and then to a trimming station. At the trimming station, the book is deposited in a nest and is positioned relative to a trimming blade which is actuated to trim a first edge of the book to a predetermined dimension. The book is then rotated to trim second and third edges thus resulting in a perfect bound book accurately trimmed to a predetermined size. A method of binding and trimming a perfect bound book is also disclosed.

22 Claims, 10 Drawing Sheets

U.S. PATENT DOCUMENTS

| | | | | |
|---|---|---|---|---|
| 5,006,396 | | 4/1991 | VanBortel et al. . | |
| 5,009,138 | * | 4/1991 | Rettie | 83/733 |
| 5,108,244 | * | 4/1992 | Bellanca | 412/37 |
| 5,137,409 | | 8/1992 | Honegger . | |
| 5,259,285 | * | 11/1993 | Uchida | 83/934 |
| 5,295,775 | * | 3/1994 | Andjelic et al. | 412/2 |
| 5,340,155 | | 8/1994 | Podosek . | |
| 5,350,268 | | 9/1994 | Muller . | |
| 5,354,045 | * | 10/1994 | Boldrini et al. | 271/11 |
| 5,374,050 | * | 12/1994 | Prim | 271/221 |
| 5,417,535 | * | 5/1995 | Andjelic et al. | 412/2 |
| 5,465,213 | | 11/1995 | Ross . | |
| 5,496,253 | | 3/1996 | Snellman et al. . | |
| 5,536,044 | | 7/1996 | Luhman et al. . | |
| 5,569,012 | * | 10/1996 | Kosasa et al. | 412/33 |
| 5,632,587 | * | 5/1997 | Coyette | 412/11 |
| 5,647,714 | * | 7/1997 | Lundberg | 412/1 |
| 5,647,715 | | 7/1997 | Stolz . | |
| 5,660,515 | * | 8/1997 | Hartsoe | 412/1 |
| 5,724,075 | | 3/1998 | Smith . | |
| 5,820,325 | * | 10/1998 | Hartsoe | 412/1 |
| 5,850,774 | * | 2/1999 | Naldi | 83/733 |
| 5,868,539 | | 2/1999 | Rathert . | |
| 5,871,323 | * | 2/1999 | Clark | 412/4 |
| 5,874,812 | * | 2/1999 | Chang | 412/36 |
| 5,904,084 | * | 5/1999 | Weston | 83/733 |
| 5,924,349 | * | 7/1999 | Perazzolo | 83/733 |
| 6,012,367 | * | 1/2000 | Westra et al. | 83/934 |
| 6,017,029 | * | 1/2000 | Bates et al. | 271/3.12 |

* cited by examiner

SYSTEM FOR AND METHOD OF BINDING AND TRIMMING A PERFECT BOUND BOOK

CROSS-REFERENCE TO RELATED APPLICATIONS

Not applicable.

STATEMENT REGARDING FEDERALLY SPONSORED RESEARCH OR DEVELOPEMNT

Not applicable

BACKGROUND OF THE INVENTION

This invention relates to a system and method of binding a perfect bound soft cover book. Typically, such soft cover books comprise a plurality of pages (referred to as a book block) having one edge which is referred to as the spine. The cover is of a suitable cover stock thicker than the pages comprising the book block. The cover has a front cover that overlies the front of the book block, a back cover that overlies the back of the book block, and a center portion spanning across the spine of the book block. A suitable adhesive is applied between the spine of the book block and the inside face of the center portion of the cover. The edges of the pages comprising the book block forming the spine are imbedded in the adhesive which, upon curing, securely adheres the cover to the book block and secures the pages of the book block to one another and to the center portion of the cover thus permitting the book to be opened to any page without the pages coming loose.

In high volume production processes for manufacturing such perfect bound books, specially developed machines jog the pages of the book block so as to insure that the edges of the pages are properly aligned with one another. The adhesive (a suitable hot melt adhesive) is applied to the spine of the book block. The cover (which is usually pre-printed) is wrapped around the front, the spine and the back of the book block and the cover is firmly clamped to the book block proximate the spine such that the center portion of the cover is firmly pressed against the adhesive between the spine of the book block and the inner face of the center portion thereby to properly adhere the cover to the book block and to adhere the pages to one another and to the center portion of the cover. Typically, such perfect bound books are printed on page that is somewhat larger than the desired size of the finished and bound book to be produced. These books, after they are bound, are trimmed along three sides to the desired final dimensions in a separate trimming machine. Heretofore, such operations were carried out in separate machines that required considerable setup to bind books of different sizes and thus were best suited for production runs of many books. In addition, these prior binder/trimmer machines were very expensive.

In recent years, book printing has undergone changes as computer technology and laser printers have advanced. This new technology now allows for on demand printed books. These on demand printed books may come in a variety of formats and thicknesses. This has created a need from an economical binding apparatus and system which is sufficiently flexible to allow on demand printed books of varying size and thickness to be bound and trimmed, even if books of different formats (size) and thickness must be bound one at a time (i.e., with production binding runs consisting of a single book copy), and yet where such binding and trimming operations are fully automated such that a store clerk or attendant need merely feed the printed pages constituting the book block and the printed cover of the book to be bound into the apparatus and a bound, trimmed book is produced in a short tine. In addition, there has been a need for short runs of perfect bound books where the size or format of the book can be readily changed from run to run without the need of undue experimentation or adjustment of the apparatus to produce such different size books.

SUMMARY OF THE INVENTION

Among the several objects and features of the present invention may be noted the provision of such a binding apparatus which has sufficient speed to bind and trim one copy of a book using the perfect binding method while another copy of the book (or a copy of another book) is being on demand printed;

The provision of such binding apparatus which, once the book block has been transferred to the binding apparatus, jogs the pages of the book block and mills the edges of the book block which form the spine of the books so as to better accept the adhesive;

The provision of such binding apparatus which applies a suitable adhesive so as to be disposed between the spine of the book block and the inner face of the center portion of the cover;

The provision of such a binding apparatus which clamps the cover to the margins of the front and back of the book block proximate the spine with the center portion of the cover substantially centered with respect to the spine thereby to allow the adhesive to properly adhere the cover to the spine and to adhere the pages in the book block to one another and to the center portion of the cover;

The provision of such binding apparatus which has a trimmer adapted to receive the oversized bound book block and cover from the clamping section so as to trim a first edge thereof, to turn the book 90° to trim a second edge, to turn the book another 90° to trim a third edge, and then to eject such bound and trimmed book;

The provision of such a binding and trimming apparatus which may be automatically set up to bind and trim books of different thicknesses and sizes such that a single copy of such different sized books may be reliably bound and trimmed to specified dimensions without manual set up and without binding attempts of sample book blocks and covers;

The provision of such a binding and trimming apparatus having a binding/trimming rate of about one minute/book;

The provision of such a binding and trimming apparatus and method which accommodates books within a wide range of sizes (e.g., between 6 inches ×9 inches and 8 ½ inches and 11 inches) and within a wide range of thicknesses (e.g., ranging from between ¼ inches and about 1 ½ inches);

The provision of such a binding and trimming apparatus which, upon receiving data corresponding to the size and thickness (number of pages) of the book to be bound automatically adjusts the clamping section to accommodate such book with the cover properly centered with respect to the spine of the book block and properly adjusts the trimmer so as to trim the excess width and height of the book block and cover thereby to produce a bound book corresponding to the desired size for the finished book;

The provision of such a binding and trimming apparatus in which various sizes and formats of books may be accommodated and where various adjustments within the apparatus for the different operations (e.g., positioning of the spine of the book block with respect to the center of the cover and trimming of the edges or margins of the bound book) are automatically adjusted upon inputting such information into the control system, either manually or where such information is associated with data automatically provided to the system; and The provision of such a binding and trimming apparatus which does not require special training for use, which is of economical construction, which has a relatively fast production speed, and which is reliable in operation.

Other objects with be in part apparent and in part pointed out hereinafter.

Briefly stated, the binding and trimming apparatus of this invention comprises a carriage movable along a work path, the carriage receiving a plurality of substantially rectangular pages constituting a rectangular book block, with the pages of the book block oriented such that minor dimension of the book block extends vertically and such that one major edge of the book block is the lowermost horizontal edge of the book block with this lowermost edge being referred to as the spine of the book block. The work path has a jogging station, a milling station, an adhesive application station, a clamping station and a trimming station located therealong. The carriage loosely holding the loose pages of the book block such that a jogging mechanism may mechanically vibrate the pages so as allow the pages to move with respect to one another such that the lowermost edge of each page is positioned relative to one another such that the edges of the pages constituting the spine of the book block are substantially in the same horizontal plane and such that minor edges of the pages are substantially in the same vertical planes. The carriage securely grips the jogged pages and transports the book block from the jogging station to the milling station where a suitable knife mills the lowermost margin of the book block so as to insure a substantially coplanar spine. The carriage then transports the book block to the adhesive application station where a suitable adhesive is applied. At the binding station, a cover for the book to be bound is positioned such that the center portion of the cover is in register with and is substantially centered with respect to the spine of the book block with the adhesive disposed between the spine and the inner face of the cover. The binding station includes a clamp which engages the cover proximate the spine and forcefully compresses the cover onto the front and back faces of the book block proximate the spine thereby to adhere the center portion of the cover to the spine of the book with the adhesive bonding the cover to the spine of the book and with the adhesive bonding the pages of the book block to one another proximate the spine and to the center portion of the cover. The carriage further carries the bound book to the trimming station. The trimming station has a trimming blade capable of trimming the cover along a first edge. The trimming station has a book positioner which positions a first edge of the book to be trimmed in a desired position with respect to the trimming blade such that when the trimming blade is actuated, a predetermined amount of the cover and the book block along this first edge is trimmed from the book. The trimming station further has a book turning mechanism that turns the book about 90° such that a second edge of the book to be trimmed faces the trimming blade. The book positioner moves the book relative to the trimming blade so that upon actuation of the trimming blade, a predetermined amount of the cover and the book block along this second edge is trimmed from the book. The book turning mechanism then turns the book about 90° such that a third edge of the book to be trimmed faces the trimming blade. The book positioner moves the book relative to the trimming blade so that upon actuation of the trimming blade, a predetermined amount of the cover and the book block along this third edge is trimmed from the book thereby to produce a perfect bound book trimmed along three edges to a predetermined size.

BRIEF DESCRIPTION OF THE DRAWINGS

Corresponding reference characters represent corresponding parts throughout the various views of the drawings.

DESCRIPTION OF A PREFERRED EMBODIMENT

Figure 3:
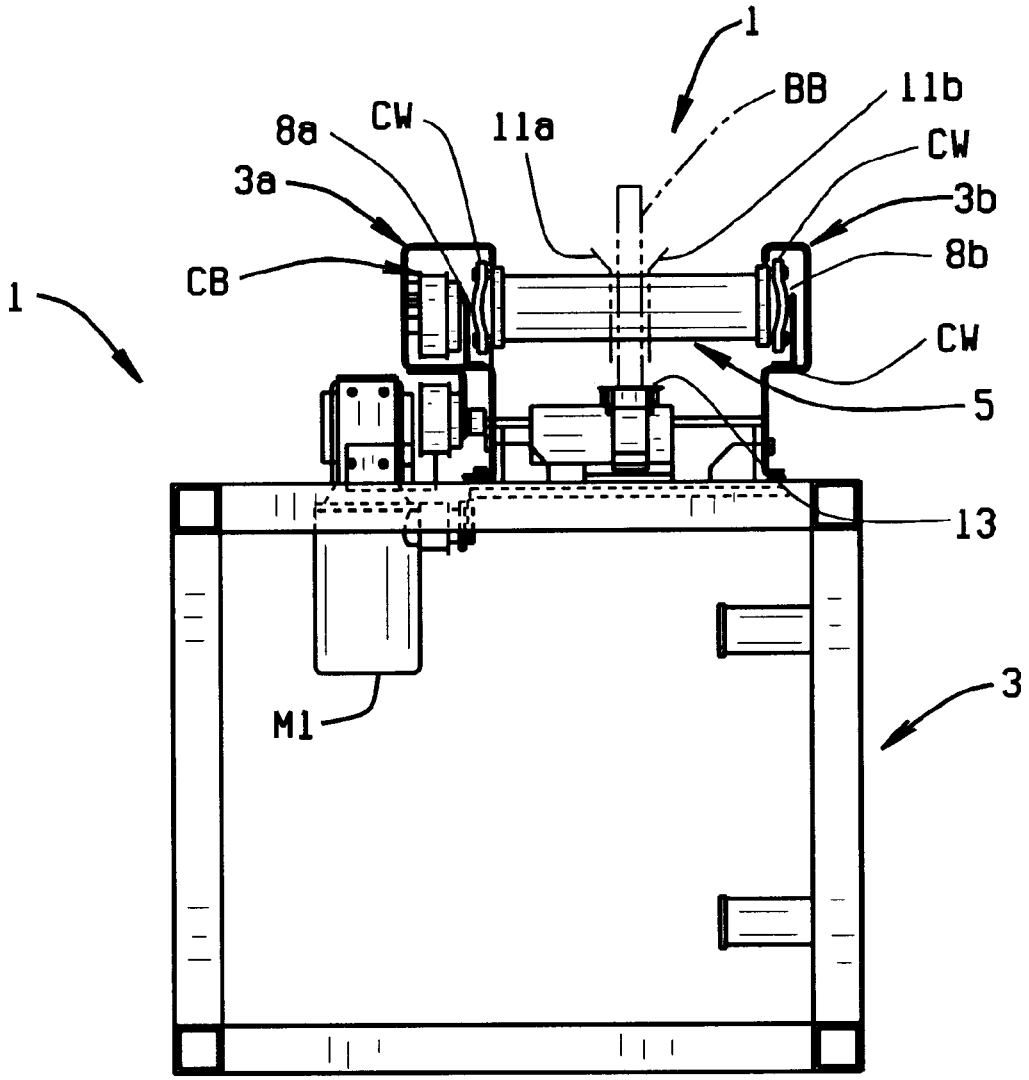
FIG. 3 is a left end elevational view taken along line 3—3 of FIG. 2.
Figure 4:
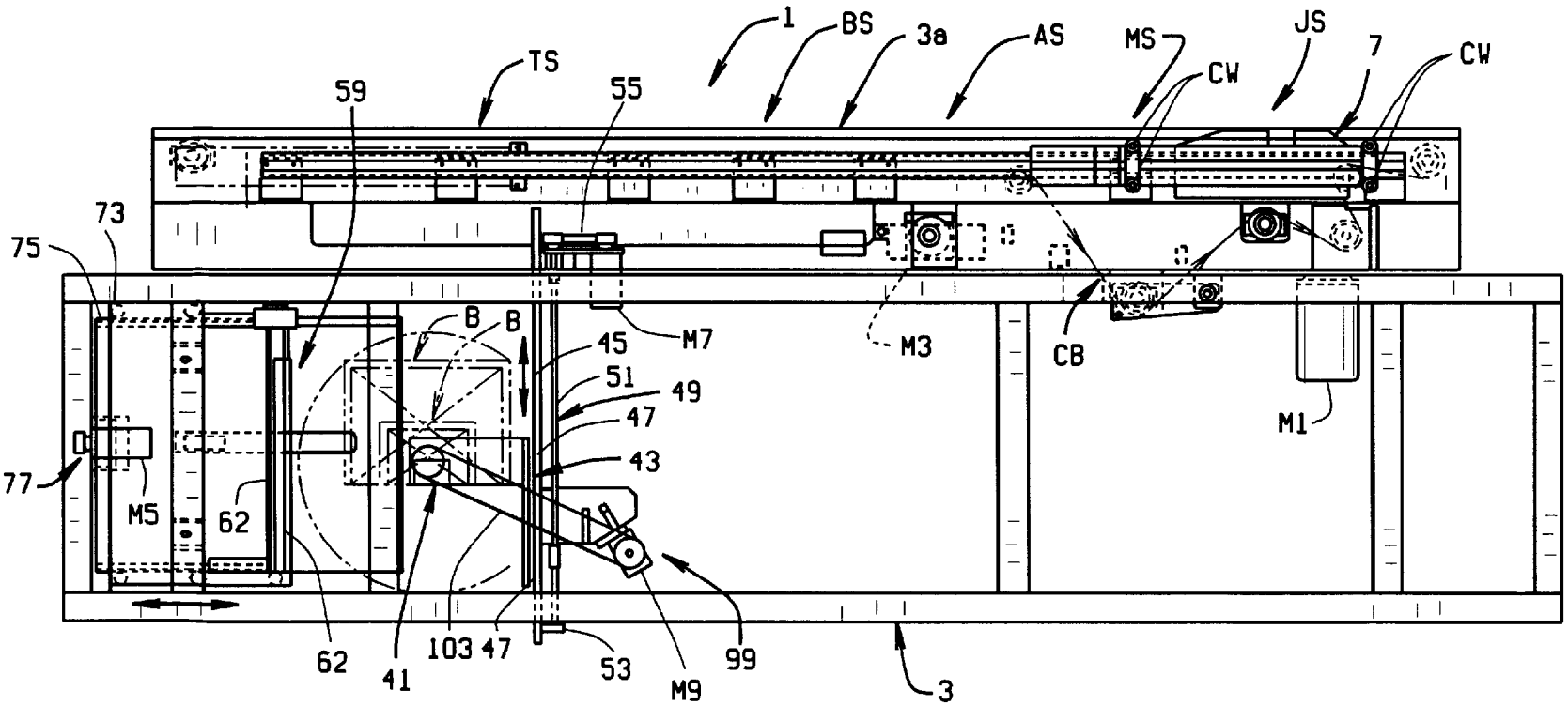
FIG. 4 is a rear side elevational view of the binder/trimmer, as shown in FIG. 1.
Figure 12:
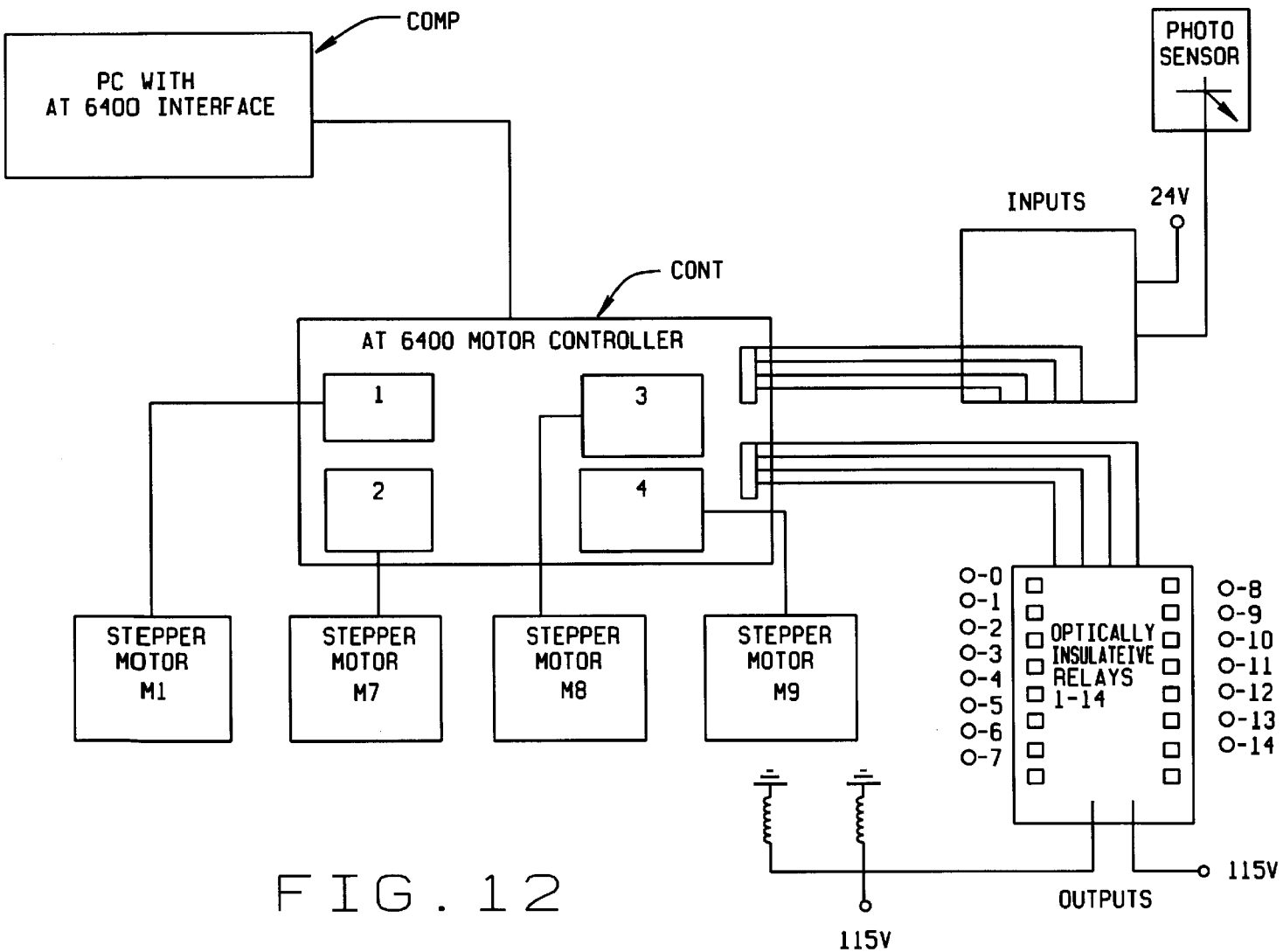
FIG. 12 is a schematic of the electrical system of the apparatus.

Referring now to the drawings, a binder/trimming apparatus of this invention is indicated in its entirety by reference character 1. The binder/trimmer has a frame 3 made of welded square steel tubes. A cover may be secured to the frame, but it has been omitted for the sake of clarity. The frame has a pair of spaced horizontal frame rails 3*a*, 3*b* extending substantially the length of the binder/trimmer. A conveyor 5 is provided between the frame rails for transporting or conveying a book block BB along a work path WP, as will be described hereinafter. Conveyor 5 includes a carriage 7 movable in horizontal direction on carriage wheels CW which bear on carriage rails 8*a*, 8*b* mounted to respective frame rails 3*a*, 3*b*, as best shown in FIG. 3. The carriage is power driven along the carriage rails by means of a conveyor stepper motor M1 that drives the carriage by means of a toothed timing belt and pulley arrangement, as indicated at CB. As best shown in FIG. 4, one end of the timing belt is attached to one end of carriage 7 and the belt is trained around a drive pulley on motor M1 and around other pulleys journalled on frame 3 and the other end of the belt is attached to the other end of the carriage. Preferably, conveyor motor M1 is a stepper motor driven by a control system CONT, as will be hereinafter described and which is shown in FIG. 12, so that the position of the carriage (and hence the book block carried thereby) is accurately known (i.e., to within about 0.005 inches) with respect to a reference surface of carriage 7 so that the position of the book block is accurately known by the control system CONT as the book block is carried along the work path and as the book is bound and trimmed, as will be hereinafter discussed in detail. In this manner, upon energization of motor M1 under the control of control system CONT, carriage may be accurately stopped at any position or work station along work path WP and the book block will be accurately positioned at a desired location. Motor Ml can be driven in reverse so as to move carriage 7 in reverse direction along the conveyor to return the carriage to its starting position so as to receive the next book block to be bound.

Figure 10:
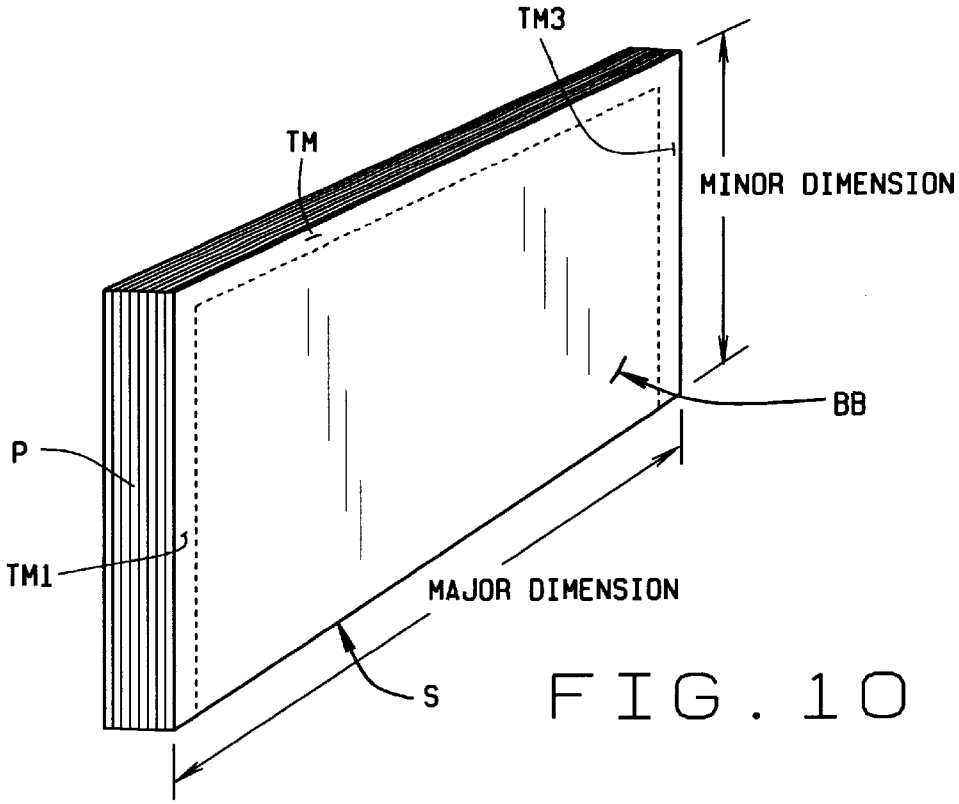
FIG. 10 is a perspective view of a book block.

As shown in FIG. 10, book block BB is shown to comprise a plurality of pages P, which generally constitute the text pages of a book to be bound. The number of pages making up the book block may range between a minimum number and a maximum number of pages, depending on the range of binding thicknesses to be accommodated by the binder/trimmer 1. For example, the thickness of the book block BB may range from about ¼ inch (or less) to about 1½ inches (or more). This thickness range may accommodate books up to about 750 pages (or more), depending on the thickness of the paper used. The minimum thickness of books to be bound by apparatus 1 is generally dependent on the minimum thickness of the book block to be bound within the cover. Generally, book blocks with less than about 50 pages are not perfect bound, but in theory, a book with even a single page could be bound by the binder/trimmer of the present invention.

Figure 1:
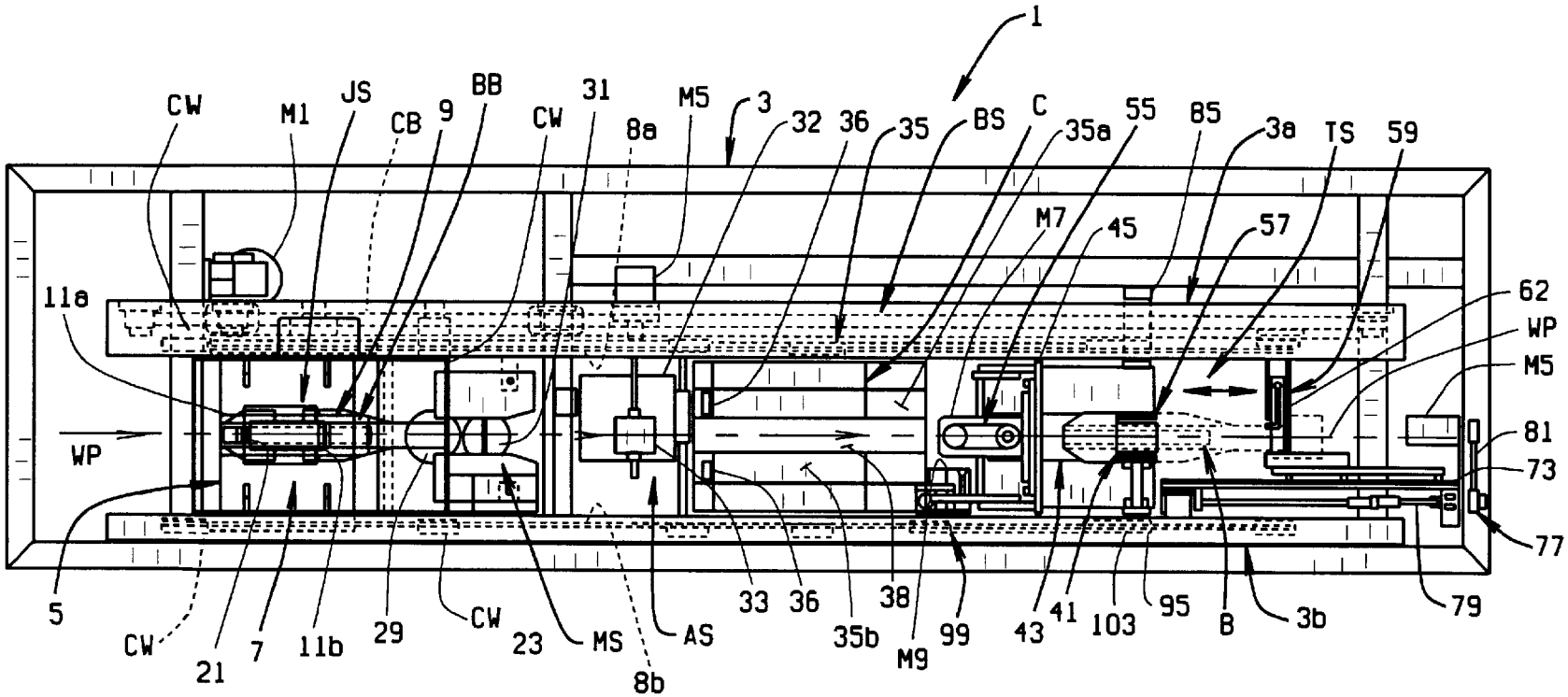
FIG. 1 is top plan view of a binder/trimmer of the present invention illustrating a work path along which a book block to be bound is transported to a jogging station JS and thence to a milling station MS and thence to an adhesive application station AS and thence to a binding station BS where the book block is bound to a cover, and thence the bound book and cover are delivered to a trimming station TS at which margins of up to three sides of the bound book are trimmed to predetermined dimensions.
Figure 2:
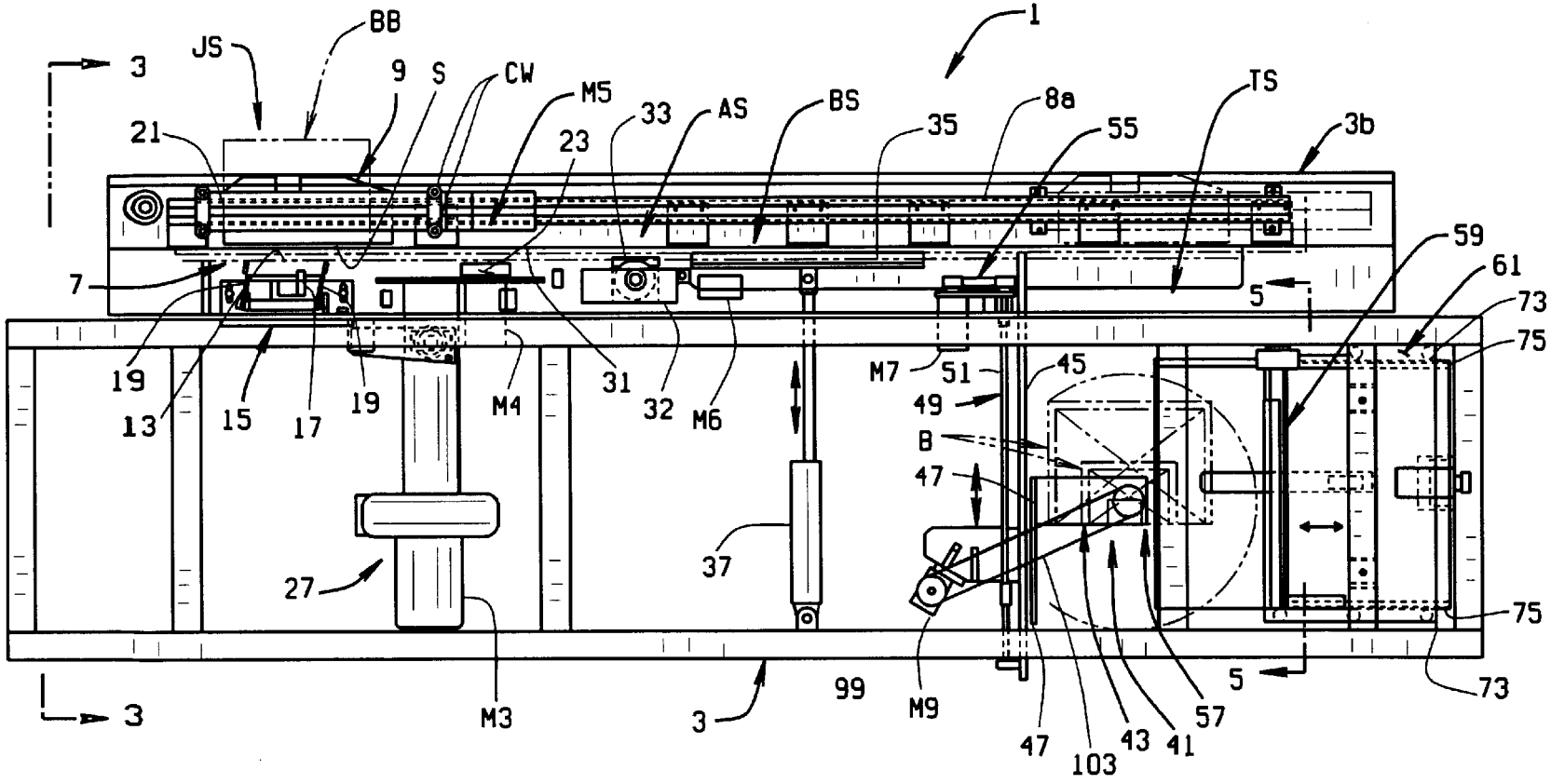
FIG. 2 is a front side elevational view, as viewed from along the direction of travel of the book block along the work path, of the binder/trimmer shown in FIG. 1.

Typically, the pages P of book block BB are printed on the front and back and the pages are rectangular having a minor dimension and a major dimension. The pages may, for example, range between a 6 inch ×9 inch rectangular format and 8½ ×11 inch rectangular format, or any number of rectangular formats within the above range. Of course, other formats may be accommodated by adjusting or by redesigning the size of the binder/trimmer in a manner well understood by those skilled in the art having knowledge of the instant disclosure. It will be understood that the binder/trimmer apparatus 1 of the present invention may automatically accommodate any book size within the range of sizes. One edge of book block BB is referred to as the spine S of the book block. As contemplated, the spine of the book block corresponds to the lowermost horizontal edge of the book block (typically one major rectangular dimension) as the book block BB is placed in the binder/trimmer 1 of the present invention, as shown in FIGS. 1 and 2. The pages of the book may be printed on both sides by a suitable duplex laser printer or they may be printed by any conventional printing process (e.g., offset printed or the like).

Figure 11:
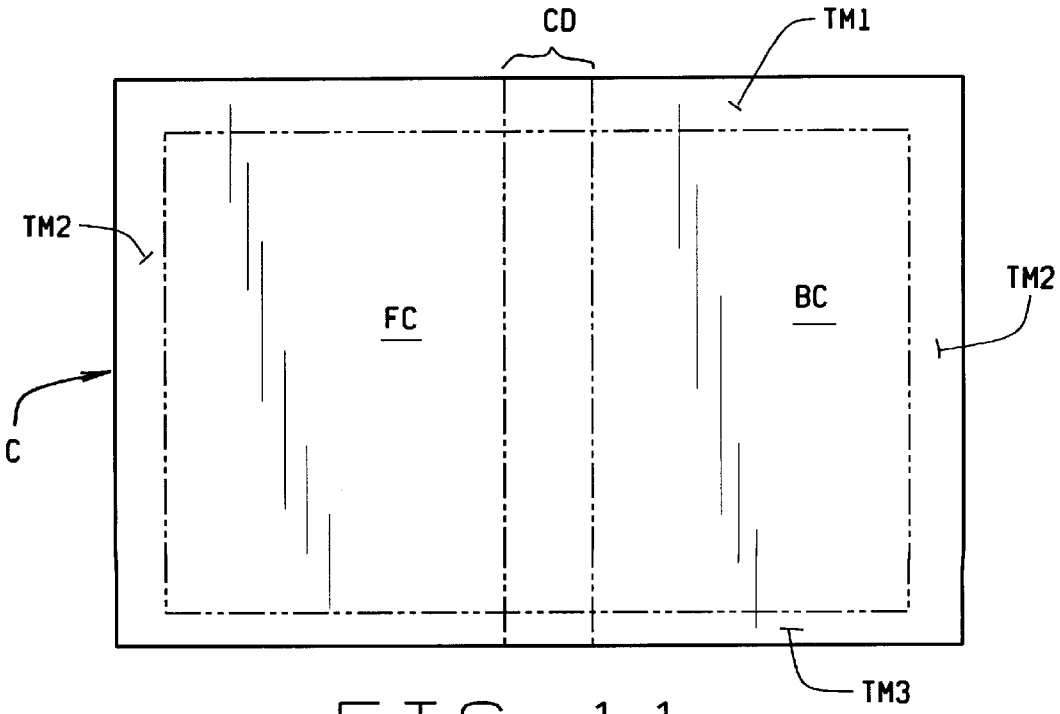
FIG. 11 is a plan view of a cover blank 1 illustrating the front and back covers of the cover blank and a center portion and further illustrating the edges or margins of the cover to be trimmed to a predetermined size after the book has been bound.

As shown in FIG. 11, the book block BB is adapted to be bound in a suitable cover C by a binding technique or method referred to as perfect binding. Typically, books bound by the perfect binding method are soft cover books. The cover C is typically of a suitable stock of heavier weight than the pages of the book block BB and may be coated so as to have a better finish and may be color printed. The cover has a front face FC, a back face BC, and a center portion CP therebetween. The width of the center portion CP generally corresponds to the thickness of the book to be printed. Typically, the pages P of the book block and the cover C are somewhat oversize relative to the desired size of the finished, bound book such that the margins of the bound book are trimmed to a predetermined size after the book block has been bound to the cover thereby to result is the desired size and to have even edges along the sides or margins (preferably along three sides) of the book. As shown in FIGS. 10 and 11, the oversize margins of the book block BB and of the cover C are shown as trim margins, TM1–TM3.

As noted, the book block BB and cover C may be printed by any method. However, because the binder/trimmer 1 of the present invention is capable of instant setup for any size or format of book to be bound (i.e., the size of the pages and the thickness of the book) within a predetermined range of book sizes (e.g., from 6 inch ×9 inch to about 8 ½ ×11 inch, and any combination of rectangular sizes within such range, and in thickness ranging from about 50 pages to about 750 pages), the binder/trimmer of the present invention is particularly well-suited to bind and trim a single book copy (or a small run quantity) of a book and cover printed on demand by apparatus as described in U.S. Pat. No. 5,465,213 and assigned to On Demand Machine Corporation of St. Louis, Mo. In this manner, the on demand printing apparatus may print a single copy of a first book in a 6 ×9 format having 300 pages, and the binder/trimmer 1 of the present invention will automatically, from the data relating to the size and thickness of the book to be bound, determine (calculate) the width of the center portion CP of cover C and the width of the trim margins TM1–TM3 to as to bind any size book within the range of book sizes that can be accommodated by the binder/trimmer 1 of this invention. The binder/trimmer has a sufficiently fast operational cycle that it will be finished binding and trimming this first book while the on demand printing apparatus is printing a second book. The second book may be of an entirely different size and thickness than the first book and the binder/trimmer 1 will automatically accommodate this second book so long as the second book is also within the range of book sizes that can be accommodated by the binder/trimmer.

Regardless of how book block BB and cover C are printed, the book block BB is loaded in a carriage 7 which is movable along conveyor 5 in horizontal direction along workpath WP. As will be described in detail hereinafter, carriage 7 is substantially centered on the work path WP and has a carriage clamping mechanism, as generally indicated at 9, which is selectively actuated to firmly hold the pages P of the book block relative to one another. This clamping mechanism 9 has vertical clamping members 11*a*, 11*b* which, upon actuation of the clamping mechanism, are preferably self-centering such that the book block BB (regardless of the thickness of the book block), as it is held within the carriage, is centered with respect to work path WP. The self-centering drive for clamping members 11*a*, 11*b* is driven by an electric motor M2. The motor M2 drives the clamping members closed through a suitable self-centering gear drive (not shown) such that the clamping members firmly grip the book block BB such that when the motor M2 stalls, the clamping members are known to have exerted sufficient gripping force on the book block so as to firmly hold the pages relative to one another as the book block is transported to the various stations along work path WP and while various operations are preformed on the book block, as will be hereinafter described. Clamping members 11*a*, 11*b* grip the front and back faces of the book block BB, but the lower margin of the book block is clear of the clamping members. Therefore, approximately 2.0 cm. of the book block extends below the clamping members.

As shown in FIGS. 1, 2, and 4, carriage 7 and the book block BB carried thereby are shown in a first station, referred to as a jogging station JS, at which location the book block is installed in carriage 7 and in which the pages of the book block are mechanically vibrated or jogged so as to allow the pages to move relative to one another such that the bottom most edges of all of the pages of the book block bear on a horizontal surface 13 and such that the leading, trailing and upper edges of the pages are substantially aligned with one another. As previously stated, the lower major dimension of the book block, referred to as the spine S of the book block, rests on surface 13 of the jogging station. The jogging operation is carried out by vibrating the book block as it is carried by the carriage by an electromechanical vibrating mechanism, as indicated at 15 (as shown in FIG. 2), which has a vibrating magnetic coil (solenoid) 17 connected to surface 13 by resilient arms 19. The magnetic vibrating coil is energized by a suited power supply (not shown) under the control of control system CONT. Preferably, during the jogging operation, carriage clamp 9 is actuated in such manner as to hold the pages P of the book block in vertical position, but so as to loosely hold the pages of the book block relative to one another such that they may move relative to one another during the jogging operation thereby to permit the pages to align with one another. During the jogging operation, the pages of the book block are preferably vibrated in such manner that the pages move rearwardly relative to carriage 7 such that the trailing edges of the pages of the book block contact a vertical surface 21. This vertical surface 21 of carriage 7 thus provides an accurate reference position for the trailing edge of the book block. In a manner as will appear, the control system CONT, upon being supplied with the size of the book block and cover of the book to be bound, can thus calculate the leading edge of the book block and the cover in reference to vertical carriage surface 21 as the book block (and later with the cover) are conveyed from one station to another along the work path. The trailing edge of the book block (and the bound book), as established by reference surface 21, also serves to accurately locate the book with respect to the trimming apparatus which is part of the binder/trimmer 1 of this invention and which will be described in detail hereinafter.

Further, the horizontal plate 13 of the jogging station serves as a reference surface for establishing the elevation of the spine S of the book block as the latter is transported along the work path WP. As noted above, carriage 7 is moved along the work path WP by stepping motor M1 via the timing belt and pulley arrangement CB such that the position of the carriage (and hence the position of the book block carried thereby) may be accurately controlled at any point along the work path to an accuracy of within about 0.005 inches or about 0.127 mm. Upon completion of the jogging operation (which may only take a second or so), the carriage clamp motor M2 is energized so at to actuate clamp 9 to firmly clamp the pages of the book block together and to firmly hold the book block BB in a fixed position relative to carriage 7 as the carriage is moved along the work path. The thickness of the book block BB being bound and the clamping pressure exerted by clamp members 11*a*, 11*b* is accommodated by energizing motor M2 to close the clamp and to allow the motor M2 to stall upon the clamp member firmly engaging the book block and exerting clamping force thereagainst. Carriage 7 was commercially acquired from the Martin Yale Industries, Inc. of Wabash, Ind., and was modified as to operate as herein described.

Carriage 7 and the book block BB carried thereby are moved by conveyor 5 from the first or jogging station JS to a second station along work path WP. This second station is referred to as a milling station MS, at which a mechanical milling or spine grooving head, as generally indicated at 23, mills or otherwise removes material from the lowermost edge of each of the pages (i.e., the spine S) of the book block thereby to insure that the spine of the book block has a roughened surface so as to better bond to the adhesive and so as to insure that the lowermost edges of the pages are coplanar. Further, it will be understood that the milling head 23 may be utilized to form or mill grooves across the spine of the book block so as to aid in bonding of the pages of the book block to one another and to the cover upon binding of the book with the adhesive as will be hereinafter described. The milling station MS is provided with a vacuum dust or debris collector, as generally indicated at 27, driven by a motor M3. The inlet opening for the dust collector is shown at 29 in FIG. 1. The milling head 23 is rotary driven by a motor M4 at high speed and has a milling blade 31 (as shown best in FIG. 2) which engages the spine of the book block as the latter is conveyed over the milling head by carriage 7. It will be understood that the milling operation is only intended to remove little or none of the spine S of the book block, but rather roughens the surface of the spine and creates a good adhesive gripping surface on the spine. The milling blade 31 is a single blade carried on the rapidly rotating milling head, and, depending on the speed at which the book block within carriage 7 is moved across the milling head, the milling blade will roughen and cut shallow grooves in the spine. These grooves hold a supply of adhesive and result in the cover C being firmly adhered to the center portion CP of the cover. This milling station was commercially acquired from the Martin Yale Industries, Inc. of Wabash, Ind.

Downstream from milling station MS along the work path WP is next located an adhesive application station, AS. As shown, this adhesive application station includes a hot melt adhesive bath 32 (as shown in FIG. 1) in which a quantity of a suitable hot melt adhesive of the type which is well known in the book binding art is heated to a liquid state.

The adhesive application station AS further has an adhesive applicator roller 33 which is partially immersed in the liquid hot melt adhesive and which is rotary driven by a motor M3 such that the roller picks up a coating of the liquid hot melt adhesive on its cylindrical face. The upper portion of roller 33 is positioned to be generally tangent to the spine of book block BB as the book block carried by carriage 7 is conveyed along the work path WP over roller 33. Thus, as the spine of the book block is conveyed over roller 33, a quantity of hot melt adhesive is applied to the spine of the book block. Roller 33 is rotary driven by a motor M5 (as shown in FIG. 1) at approximate the surface speed as the speed that carriage 7 moves along work path WP so as to pick up molten adhesive from bath 32 therefore and to lay down a substantially continuous coating of the liquid hot melt adhesive on the spine S of the book block as the latter is conveyed over the roller. This roller motor M5 is energized and de-energized by a micro-switch (not shown) tripped by movement of the carriage 7 as it approaches and leaves the adhesive station. This hot melt bath and roller is commercially available from the Martin Yale Industries, Inc. of Wabash, Ind. It will be understood that he bath 32 therefore is provided with suitable heaters so as to heat the adhesive to a desired temperature and is further provided with a thermostat control system to maintain the adhesive in the bath at a desired temperature.

The book block BB is conveyed by carriage 7 from the adhesive application station AS to the next work station, referred to as the binding station BS. At this binding station, a binding clamp, as generally indicated at 35, is provided. The binding clamp is commercially available from Martin Yale Industries, Inc. of Wabash, Ind. This binding claim includes a pair of self-centering, power operated clamp members 35*a*, 35*b*, driven by a motor M6. These clamp members are disposed on opposite sides of the book block. The clamp members 35*a*, 35*b* are driven between their open and closed positions by a motor M6 by means of a suitable gear train (not shown). As shown in FIG. 1, the clamp members 35*a*, 35*b* are in their open position with their inner edges spaced apart a distance sufficient to accommodate the thickness of the book block BB to be bound to a cover C.

Referring to FIG. 2, it can be seen that clamp members 35*a*, 35*b* are positioned just below the level of the bottom surface 13 of carriage 7 with the clamp members disposed to engage the side faces of the book block below the level of carriage clamp members 11*a*, 11*b*, just above the level of spine S of the book block. As provided, one lateral side of this binding clamp is hingedly mounted to rail 3*a* and is selectively movable between a lowered position in which the clamp members 35*a*, 35*b* are positioned below the level of the spine S of the book block as carriage 7 moves the book block (with the adhesive applied to the spine) into position over the binding clamp 35. Clamp members 35*a*, 35*b* are provided with cover positioning pins 36 which accurately locate a cover C relative to the book block BB to be bound therein. In this manner, with the cover installed on the clamping members 35*a*, 35*b*, the center portion CP of the cover may be disposed over the opening between the clamping members 35*a*, 35*b* and the cover is substantially centered with respect to the spine of the book block.

When carriage 7 with book block BB therein is stopped at binding station BS, the book block is positioned above cover C with the spine S over the center portion CP of the cover. The book block is transported from the adhesive application station to the binding station in such a short time that the adhesive substantially does not appreciably cool or otherwise begin to set up before the binding operation begins. With the book block so positioned over the center portion of the cover and with the book block substantially correctly positioned with respect to the cover (i.e., the center of the spine S of the book block is centered with respect to the cover both laterally and vertically), a combination hydraulic pump/electric motor PM4 is energized so as to pressurize a fluid cylinder 37 so as to effect the raising of clamp 35 from its lowered position to a raised binding position in which a portion of the clamp 35 is substantially horizontal and in which a surface 38 between the clamps 35*a*, 35*b* is moved into engagement from below the outer face of the center portion CP of cover C so as to raise the center portion of the cover and to force it into adhesive engagement with the adhesive applied to the spine S of the book block. The clamp member 35*a*, 35*b* are then power driven closed by means of a motor M6 which acts through a self-centering mechanism so as to insure that clamp members 35*a*, 35*b* substantially simultaneously engage the outer surface of the book immediately above the level of spine S. As the clamp members 35*a*, 35*b* close on the cover C and the book block BB, the motor M6 will stall thus insuring that sufficient clamping force has been applied to properly bind the book.

As the clamp members close on the cover and the book block, this has a tendency to stretch the cover around the spine and the lower margins of the book block BB proximate the spine S thereby to insure that the cover tightly conforms to the spine of the book block, preferably without the formation of wrinkles in the center portion CP of the cover C. The clamp members 35*a*, 35*b* hold a clamping force on the front and back face of the book being bound just above the level of the spine S. These clamp members are maintained in clamping relation with the book for only a matter of seconds until the adhesive properly sets up (e.g., cools) thereby to effect the binding of the book block to the inner face of the center portion of the cover. The outer surfaces of clamp members 35*a*, 35*b* may be coated with a suitable low friction/non-stick material such as a Teflon tape to insure that cover C may be freely moved on the clamp members and to insure that any spilled hot melt adhesive may be readily cleaned from the clamp members.

Preferably, with the book block correctly positioned with respect to the cover, the desired trim margins TM for both the cover and the book block are established. The relative position of the cover C and the book block is established by the book block being positioned within carriage 7, as determined by vertical reference surface 21, and by positioning cover C at the binding station BS in a predetermined position. In this manner, with the cover C properly positioned, the carriage will stop at the binding station with the spine S of the book block BB centered with respect to the center portion CP of the cover, and with the book block substantially centered in heightwise relation to the cover. While it has not been found necessary to do so in all cases, for some cover stock materials which are thicker than conventional cover stock material, the cover C may be scored along either side of the center portion CP of the cover in the manner shown in my above-described U.S. patent application No. 09/016,156 which has been herein incorporated by reference.

At this time, hydraulic pump motor PM4 is energized so as to raise binding clamp 35 from its lowered or retracted position to a raised position in which the clamp members 35*a*, 35*b* are substantially horizontal and in which the inner edges of the clamping members are disposed in a generally horizontal plane just above the level of spine S of the book block as the later is held by carriage clamp members 11*a*, 11*b*. This movement of the binding clamp 35 from its lowered to its raised position forces a center portion of binding clamp, as indicated at 38, against the lower face of the center portion CP of cover C against the spine S of the book block so as to substantially force the adhesive carried on the bottom face of spine S into adhesive bonding relation with the center portion of the cover and stretches the cover around the spine such that folds and wrinkles in the spine are substantially eliminated. At this time, motor M6 is energized so as to forcefully close clamping members 35*a*, 35*b* on the outer faces of the cover and on the book block just above the level of spine S. As noted, the spine is brought into adhesive bonding relation with the inner face of the center portion of the cover. This term "adhesive bonding relation" does not mean that there the spine S necessarily is in tight compressive relation with the cover, but, after the binding clamp 35 has been moved fully to its raised position, there may be a desired gap (e.g., a few mm.) between the bottom face of spine S and the inner face of the center portion CP of the cover so as to insure that a layer of adhesive remains between the spine and the cover so as to result in the satisfactory binding of the book block to the cover. It will be understood that if the spine were tightly forced onto the inner face of the cover that excessive amounts of the still liquid (or otherwise flowable) adhesive may be forced from between the spine and the cover so as to result in a weakened binding of the book. Further, it will be understood that the transverse grooves (not shown, but which may, for example, be about ⅛ inch wide, 0.020 inches deep, and on about ⅜ inch centers) which were optionally formed in the spine S by milling knife 31 act as a reservoir for holding an extra amount of the adhesive and to present additional surface area for the adhesive thereby to result in increased adhesive bonding of the pages to the cover and to one another. It will be understood that with the pages of the book block BB held tightly by carriage clamp members 11*a*, 11*b* at the binding stations, and with cover C disposed on the upper face of the binding clamp 35 (as positioned by locating pins 36), the upward movement of the binding clamp 35, as above described, causes cover to splay outwardly relative to the book block with the front and back cover FC and BC, respectively, being in nearly horizontal position beneath carriage 7.

It will be understood that the hot melt adhesive, as above described, may be omitted and replaced with a room temperature adhesive, such as is described in my co-pending U.S. patent application No. 09/016,156, filed Jan. 30, 1998, which is herein incorporated by reference. In such instance, rather than applying a coating of a hot melt adhesive to the spine S of book block BB (as above described), a suitable quantity of the room temperature, solid adhesive may be adhered to the inner face of the center portion of cover C or to the spine S of the book block as the book block is conveyed along work path WP. In the event the room temperature adhesive is to be used, the adhesive station AS, heretofore described, is replaced with the adhesive application station, as described in my above-noted co-pending U.S. patent application No. 09/016,156, filed Jan. 30, 1998. Further, the binding station BS, as above described, is replaced with the ultrasonic adhesive activation system described in my above-noted patent application. In such ultrasonic adhesive activation system, an ultrasonic horn (tool), as described in my above-noted application, is brought into working engagement with lower surface of the center portion CP of cover C and the tool is rendered resonant thereby to transmit ultrasonic energy from the tool through the thickness of the cover so as to heat the adhesive (thereby activating or melting it). The ultrasonic energy aids in forcefully driving the now activated or liquefied adhesive into adhesive engagement with pages comprising the spine S of book block BB. In this manner, the ultrasonic energy forces the adhesive vertically a short distance (e.g., a few hundredths of an inch) between the lowermost margins of the pages of the book block in the region of spine S to imbed the edges of the pages comprising the spine of the book block into the adhesive and to insure that the inner face of the center portion of the cover is adhered to the spine of the book. It should be noted that the time required for such ultrasonic energy to activate the adhesive may be very short (a fraction of a second), depending on the thickness and height of the book Upon removal of the ultrasonic energy, the adhesive will substantially instantaneously cool thus allowing the bound book to be quickly removed from clamping members 35*a*, 35*b*. In accordance with this invention, trimmer binder 1 may be readily converted between hot melt adhesive and room temperature adhesives which must be ultrasonically activated. In order to readily accomplish this changeover, the adhesive application station AS using hot melt adhesive (as herein described) may be removed from frame 3 as a unit and replaced with the room temperature adhesive applicator and ultrasonic adhesive activation unit, as described in by above-noted copending application which has herein been incorporated by reference.

As noted above, cover C and the pages P constituting the book block BB are oftentimes printed on oversize stock which needs to be trimmed along three (3) edges or trim margins TM1, TM2 and/or TM3 (i.e., along the top, outer, and bottom margins) of the bound book so as to produce a bound book of a precise, predetermined size with uniform top, bottom and outer edges. The cover stock from which cover C an on-demand printed book may be of a size such as to allow a wide range of book thickness to be printed with the center portion CP of the cover being adjustable so as to accommodate such books of a relatively wide range of thickness (as above discussed) such that the front and back faces of the cover and the center portion of the cover are printed so as to be substantially centered with respect to the stock cover size.

In accordance with one aspect of the binder/trimmer 1 of the present invention, carriage 7 further transports the now bound book from the binding stations BS to another work station, referred to a the trim station TS, along work path WP. In the manner as will be described, one, two or three edges of the bound book (i.e., the book block BB and the cover C) are trimmed (i.e., the above-described trim margins TM are removed) at trimming station TS thereby to result in a neat appearance for the bound book and to result in a bound book of a precise, predetermined size with neat and uniform edges.

Referring to FIG. 2, as the bound book is transported by carriage 7 from binding station BS to trimming station TS, the cover is bonded to the spine of the book block, but the cover is splayed into a partially open position (i.e., the cover does not lie flat on the book block) and the carriage clamping members 11*a*, 11*b* are maintained in clamping engagement with the front and back faces of the book block. Further, the spine of the book is disposed at the lower horizontal edge of the book and the trailing edge of the book block remain in engagement with vertical wall 21 of the carriage thereby to accurately position the book with respect to carriage 7. In this manner and since control system CONT "knows" the desired final (predetermined) size of the finished book, the size of the stock used for pages P of the book block BB, and the size of the stock used to print cover C, the control system has sufficient information to calculate the trim margins TM along the top, bottom and outer edges of the book so as to result in a finished, trimmed book of a desired size.

As carriage 7 moves along work path WP to trimming station TS, book clamp motor M2 is energized so as to open carriage clamp members 11*a*, 11*b* and to thereby to release the bound book B and thus allowing the book to drop vertically downwardly into a trimming nest, as generally indicated at 41. As will be described hereinafter, after the book has been released and dropped into nest 41, carriage 7 is advanced so that reference surface 21 again engages the trailing edge of the book block and nudges the book in nest 41 in forward direction (i.e., toward the right-hand end of apparatus 1, as shown in FIG. 1) thereby to accurately position the book in nest 41 and relative to a trimming knife (as will be hereinafter described) so that the trim margins TM may be accurately trimmed from the book so as to result in a book of a predetermined size. With the book properly positioned in nest 41, the book is positioned with its spine constituting its lower edge, with its pages vertical, and with one edge to be trimmed disposed toward the trimmer. The front and back faces FC and BC of cover C are disposed against the front and back pages of the book block such that the book is in its normally closed position.

Nest 41 is mounted on a vertically movable nest elevator 43 that may be selectively moved in vertical direction along a vertical track 45 on track rollers 47 by a power screw drive 49 which includes a vertical drive screw 51 journalled in bearings 53 mounted to frame 3. The drive screw is rotary driven by an electric stepper motor M7 through a timing belt and pulley drive, as indicated at 55. In this manner, nest 41 is moved to its raised position (not shown) at which it receives the bound (but not yet trimmed) book B from carriage 7. With the book B received in nest 41, stepper motor M7 is energized so as to rotate drive screw 51 in such manner as to lower nest 41 from its raised to its lowered trimming positioned (as shown in FIG. 2) for being trimmed in the manner as will appear.

Figure 5:
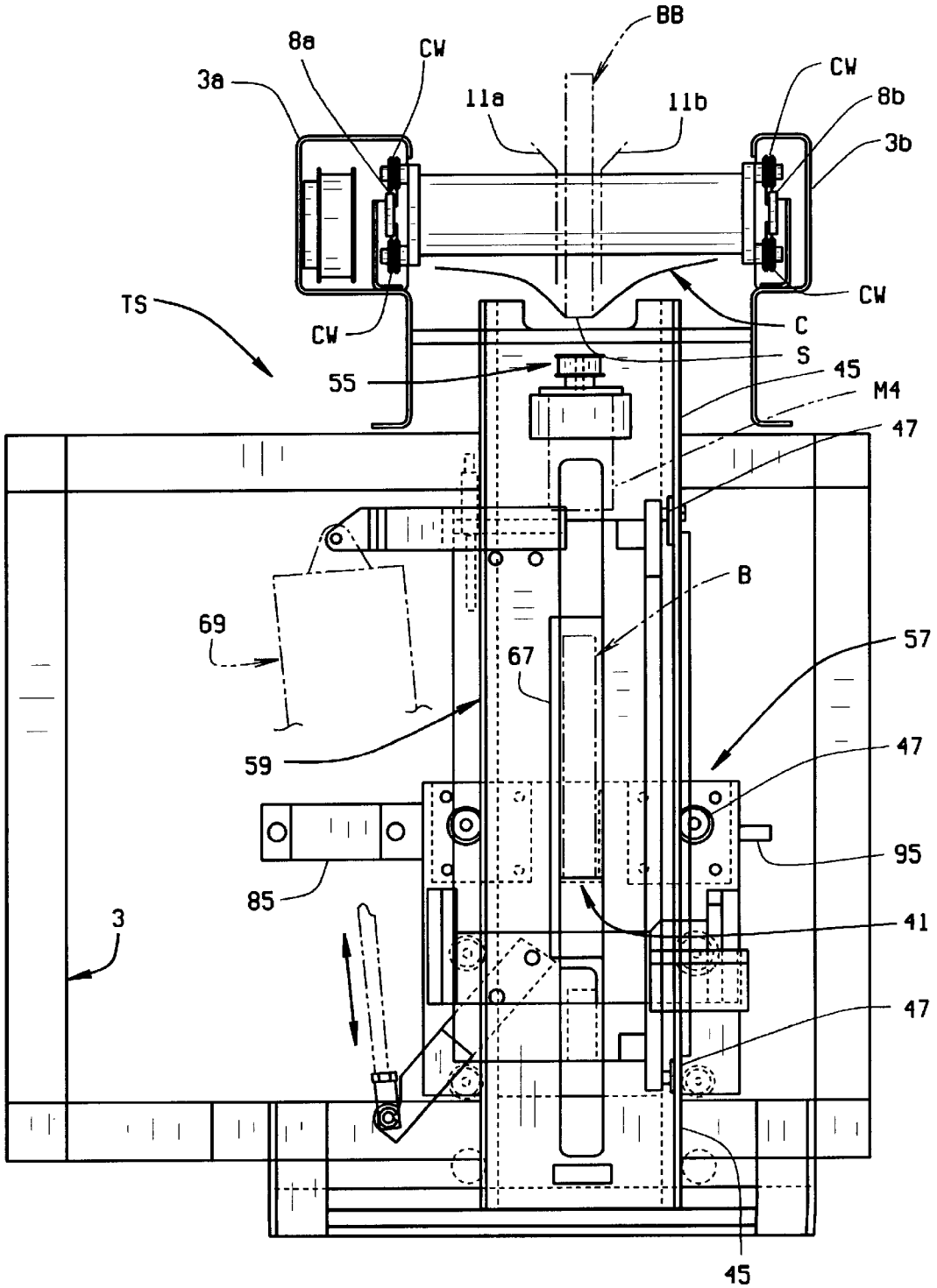
FIG. 5 is a cross sectional view on a somewhat larger scale than FIGS. 1–4 of the binder/trimmer taken along line 5—5 of FIG. 2 illustrating a shear trimmer that is partially broken away so as to illustrate a nest that receives a bound book and holds the book while being trimmed along predetermined edges or margins thereof.
Figure 7:
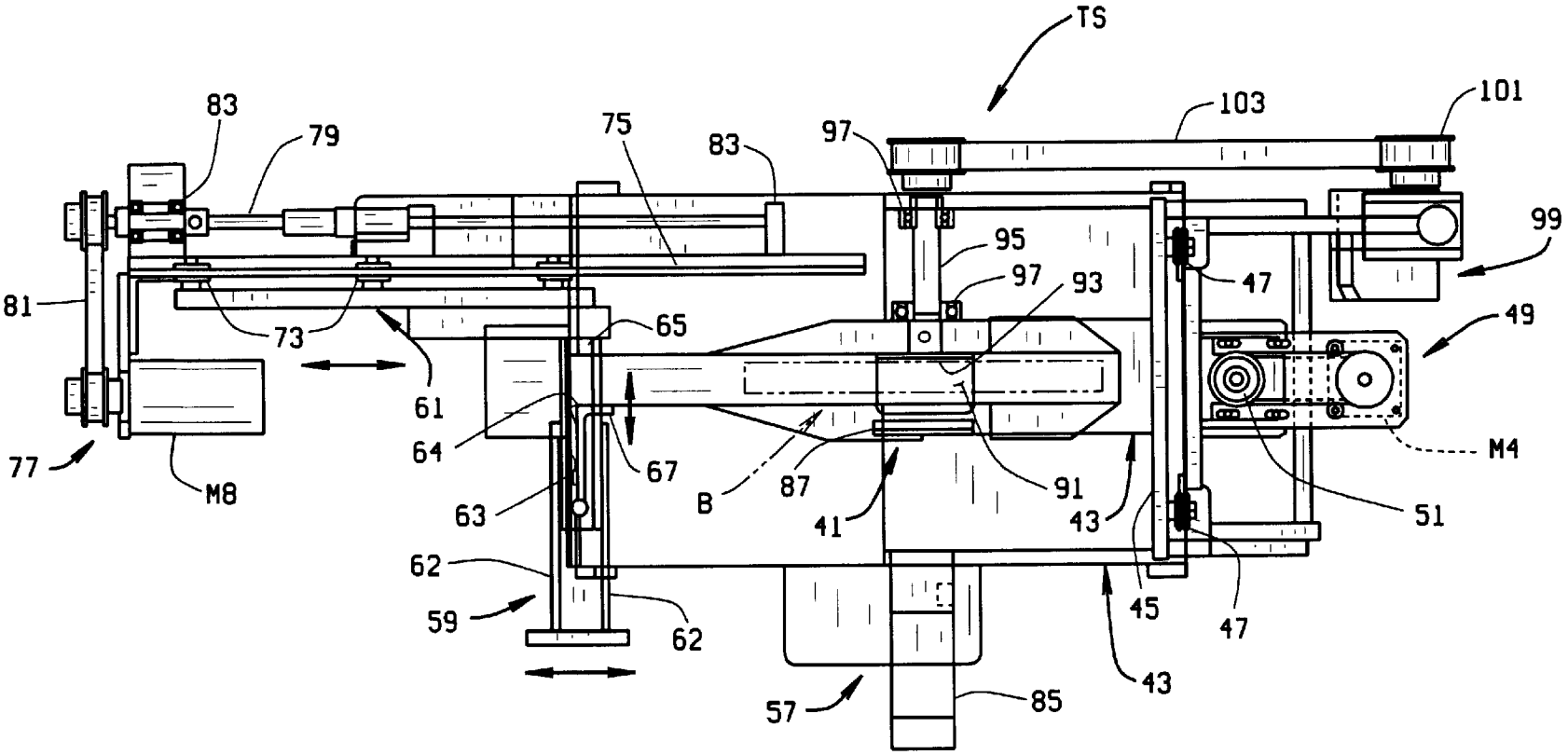
FIG. 7 is a top plan view of FIG. 6 illustrating the trimming station.
Figure 8:
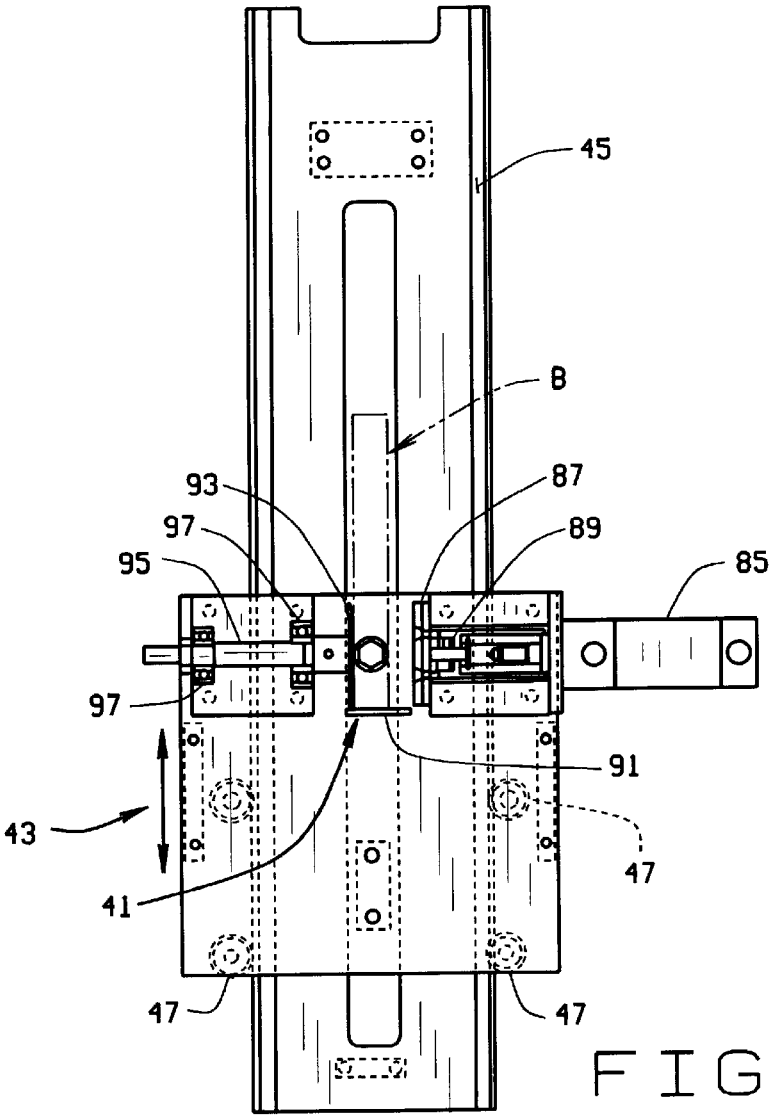
FIG. 8 is cross sectional view taken along line 8—8 of FIG. 6 illustrating a book receiving nest movable in vertical direction between a raised position in which the nest receives a bound book to be trimmed and a lowered position (as shown in FIG. 6) in which the book held in the nest is in position to be trimmed by a shear-type trimmer.
Figure 9:
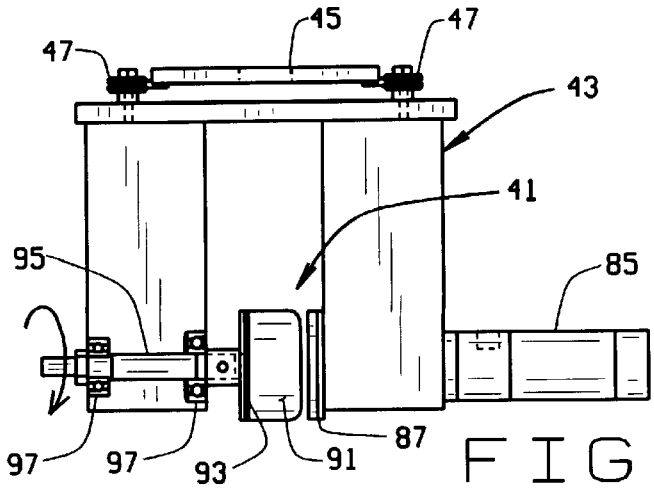
FIG. 9 is a top plan view of FIG. 8.

Nest 41 includes a book clamp 57, as best shown in FIGS. 5, 7, and 8, for holding bound book B while one or more edges thereof are trimmed, in a manner as will appear. The details of book clamp 57 and nest 41 will be more fully described hereinafter. However, book clamp 57 includes an indexing mechanism, as generally indicated at 99 (which is also described hereinafter),that operates to rotate book B held in nest 41 through an angle of 90° (or through any desired angle) from a first position in which a first edge or trim margin TM1 of book B is trimmed to a second position at which a second edge or trim margin TM2 of the book is in position such that it may be trimmed, and then the book is rotated an additional 90° to a such that a third position edge or trim margin TM3 of the book may be trimmed. Finally, book clamp 57 may be retracted or opened thereby to release the trimmed book B.

As generally indicated at 59, a book shear or trimmer is provided which may be adjustably moved into operating relation with a book held in nest 41 for trimming one, two or three sides or edges of a book B held in the nest. Preferably, trimmer 59 is a knife shear of sufficient length to trim the major dimension of the largest book B to be bound an trimmed by apparatus 1 of the present invention. Trimmer 59 is vertically mounted on a trim carriage 61 which is mounted for horizontal movement toward and away from an edge of book B held in nest 41 such that the horizontal position of the trimmer (and more particularly the vertical plane of the blade of the trimmer) relative to the trailing edge of the book deposited in the nest determines the amount of the margin of the book B to be trimmed. Of course, the horizontal position of trim carriage 61 (and hence the position of trimmer 59) is under the control of control system CONT, as will be explained.

Figure 6:
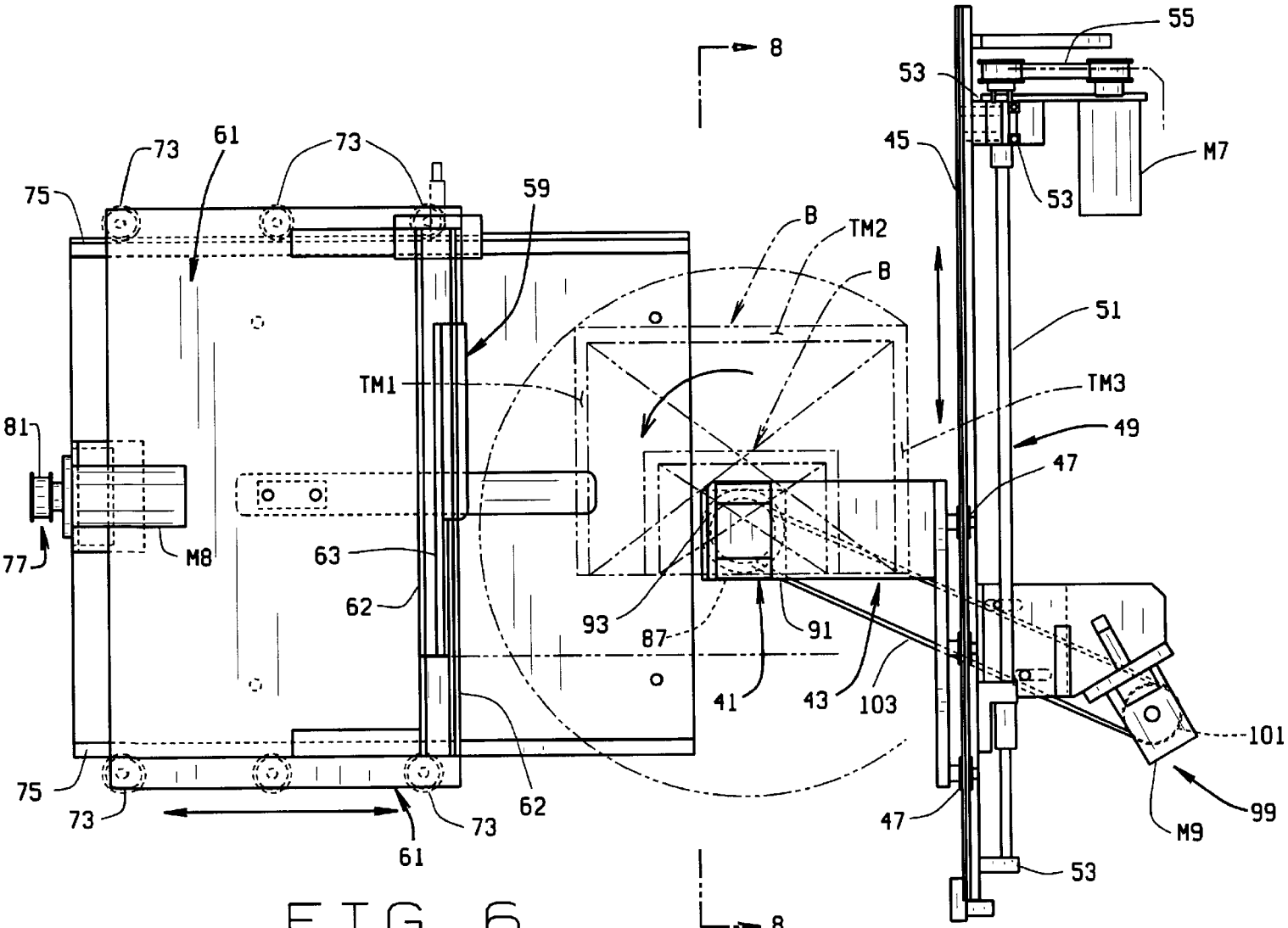
FIG. 6 is a partial side elevational view the left-hand portion of FIG. 4 illustrating the trimming station on a somewhat larger scale.

As best shown in FIGS. 6 and 7, trimmer 59 comprises a trimmer frame 62 in which a guillotine-type shear blade 63 having a shear edge 64 (as shown in FIG. 7) is mounted from moving between a fully open position and a closed trimming position. The trimmer further comprises an anvil 65 against which the book B in the area to be trimmed rests and against which blade edge 64 cuts through the upper face of the cover C, the pages P of the book block BB, and through the other face of the cover thereby to trim one edge or margin of the bound book B. The trimmer further has a book clamp 67 which is operable independently of trimming blade 63 for firmly holding the book relative to the trimming blade adjacent the trim line (i.e., the line along which blade 63 will trim the one edge of the book upon closing of trim blade 63) thus insuring that the trim blade uniformly trims the one edge of the book to be trimmed.

Movement of trim blade 63 between its open and closed position is power operated by means of a fluid cylinder, as indicated at 69 (see FIG. 5). Further, clamp 67 is power driven by another fluid cylinder 71. Each of these fluid cylinders are preferably hydraulic, but those skilled in the art will recognize that air cylinders may be used. Each of the hydraulic cylinder 69 and 71 is supplied hydraulic fluid under pressure from a dedicated unitary hydraulic pump/electric motor PM1, PM2, respectively. Such pumps may be driven in forward or reverse direction to as to reverse the pressure supplied to the cylinder 69, 71 thus to reverse their direction of movement. Thus, opening and closing of the shear blade and the shear clamp may be controlled (initiated) merely by reversing operation of the pumps without the need for any expensive hydraulic valves or the like. Of course, those skilled in the art will recognize that many other arrangements from supplying hydraulic fluid under pressure to the fluid cylinders 69 and 71 may be used.

Trimmer 59 is a modification of a book shear commercially available from the Martin Yale, Inc. of Wabash, Ind. Specifically, a Martin Yale Model 7000E Heavy Duty Shear manual shear was stiffened and the manual clamp was modified such that the book clamp could be operated by. Therefore hydraulic cylinder 71 and such that the operation of the shear blade was power driven by hydraulic cylinder 69.

As noted, trimmer 59 is mounted on trim carriage 61 for movement in horizontal direction toward and away from one edge of book B held in nest 41 to be trimmed. More specifically, trim carriage 61 is mounted on track rollers 73 which roll on a trim carriage track 75 rigidly mounted to frame 3 for movement of the trimmer between a retracted position (as shown in FIG. 6) in which the trimmer is clear of the maximum size book B to be trimmed thereby to permit rotation of the book as it is held in nest 41 for presenting another edge or margin of the book to the trimmer for being trimmed and a trimming position in which the plane of shear blade 63 is accurately positioned with respect to a margin of the book B to be trimmed. Trim carriage 61 is power driven by a power drive 77 for movement between its retracted and trimming positions. Power drive 77 is shown to comprise an electric stepper motor M8 which drives a drive screw 79 by means of a timing belt and pulley arrangement 81. The drive screw 79 is journalled with respect to trim track 75 by means of bearings 83. Under the control of control system CONT of the present invention, stepper motor M8 is controlled so as to accurately position (e.g., to within ±0.005 inches) the cutting plane of shear knife 63 relative to the margin of book B to be trimmed thereby to trim a predetermined trim margin TM from book B along the vertical edge of the book presented to the trim blade.

As shown best in FIG. 7, book clamp 57 carried by nest 41 comprises a fluid cylinder 85 having a book pressing platen 87 on its inner end for pressing against one face of book B deposited within nest 41. Fluid cylinder 85 is powered by a unitary pump/electric motor PM3 similar to the above described pump/electric motors used to supply fluid pressure to cylinder 69 and 71. Pressing platen 87 is journalled on the rod of cylinder 85 by means of a bearing 89 so as to readily permit rotation of book B with respect to the cylinder as the book B is held in clamped relation with platen 87 and when the book is rotated (in a manner as will appear) within nest 41 so as to permit a second and then a third margin of the book to be rotated into position for being trimmed by blade 63. Nest 41 includes a lower reference surface 91 for engagement with the spine S book B as the book is deposited within the nest. The nest further has a wall 93 extending upwardly from surface 91 which bears against one vertical face of the bound book B. This wall 93 is mounted on a rotary shaft 95 mounted in bearings 97 carried by elevator 43. As shown in FIG. 8, upon pressurization of cylinder 85, platen 87 is forcefully moved inwardly toward book B held in nest 41 thereby to firmly grip the book between the platen and vertical wall 93 which in turn is rotatably mounted on shaft 95 which is carried by bearings 97. In this manner, book B is firmly held in place within nest 41 thereby enabling positioning of blade 63 relative to a known position of the book in the book nest thus enabling a predetermined trim margin TM1–TM3 to be trimmed from each of three respective margins or sides of book B.

Preferably, book B is positioned in nest 41 such that the geometric center of the finished book is coaxial with the centerline of book clamp cylinder 85 and with shaft 95 such that as the book is rotated, the book will rotate about the axis of the finished book (i.e., the center of the book as trimmed).

As shown best in FIGS. 6 and 7, index drive 99 is mounted on elevator 43 for indexing shaft in increments of 90° so as to rotate book B held within nest 41 through a predetermined angle (e.g., 90°) about the horizontal axis of shaft 95 so as to present a second and then a third edge of book B for being trimmed by blade 63. More specifically, index drive is a stepper motor M9 connected to shaft 95 by means of a timing belt 103 and pulley arrangement. Upon energization of stepper motor M9 for a predetermined number of counts by control system CONT, shaft 95 (and hence book B) rotates through a 90° such that another edge or margin of the book B is rotated to assume a vertical position so that a predetermined trim margin for that edge or side of book B may be trimmed by trimmer 61. It will be understood that other arrangements for indexing book B may be used. For example, a hydraulically driven index mechanism may be used to rotate the book through angles of 90° or of other desired angles.

Referring to FIG. 6, as shown within the phantom line circle, a range of sizes of books B held by nest 41 is depicted that can be accommodated by the trimming station TS of the present invention. As shown, both the smallest and largest sizes of the books B accommodated by the apparatus of this invention is shown with the spine S of books B bearing on the upper face of nest surface 91 thereby properly positioning the book in heightwise direction relative to the shear blade 63. The phantom line circle depicts the swing of the largest size book as the book is rotated 90° from a first position in which a first trim margin TM1 is trimmed from a first edge or margin of the bound book B. The book B is positioned in nest 41 with its trailing vertical edge positioned by vertical reference surface 21 of carriage 7 such that the control system CONT accurately "knows" the position of the book within nest 41. In this manner, the trim margins TM1–TM3 may be accurately trimmed from the book so as to produce a book of a predetermined size.

Specifically, with the book so positioned within nest 41 in a first position with the leading vertical edge and trim margin TM1 disposed toward shear 59, control system CONT operates to energize stepper motor M8 an amount so as to move shear trimmer 59 from its retracted position (as shown in FIG. 6) in which trimmer blade 63 is clear of book B to a predetermined trimming position in which the vertical cutting plane of the trimmer is in register with a vertical plane substantially coincident with a vertical line on the book corresponding to a trim line so as to shear (trim) trim margin TM1 from the book. With the shear 59 in this first trimming position, pump PM2 is energized so as to close shear clamp 67 on the book thereby to firmly hold the cover and the pages of the book while the trim margin TM1 is sheared from the book. Then, pump PM1 is energized so as to actuate cylinder 69 thereby to forcefully move blade 63 from its retracted position to its cutting time thereby to cut the desired trim margin TM1 from the book. After the shearing operation is complete, pump motors PM1 and PM2 are energized in reverse direction so as to open the clamp and the shear blade.

After trimming of this first trim margin TM1, stepper motor M8 is energized so as to move trim carriage 61 from its above mentioned cutting position to its retracted position. After shear 59 is clear of the book circle, stepper motor M9 is energized so as to index nest 41 (and hence the book held therein) 90° about the horizontal axis of shaft 95 thereby to dispose a second edge or trim margin TM2 in vertical position. The control system CONT is provided with information so as to calculate the shear plane of shear 59 so that the second trim margin TM2 by be trimmed from the book. With the book rotated to this second position, stepper motor M8 is energized so as to move trim carriage 61 in horizontal direction toward the book so that the shear plane of blade 63 is positioned with respect to book B so as to trim the trim margin TM2 from the book. Again, pump PM2 is energized to actuate shear clamp 67. After the book has been so clamped, pump PM1 is energized so as to pressurize cylinder 69 and so as to trim this second trim margin TM2 from the book along a predetermined trim line. Pump motors PM1 and PM2 are energized so as to open the clamp and the shear blade. Then, stepper motor M8 is energized so as to move trim carriage 61 clear of the book. Then, the book is indexed through another angle of 90° so as to position a third edge or trim margin TM3 of the book in vertical position disposed toward blade 63. In the manner heretofore described, shear carriage is moved inwardly toward the book and the vertical plane of the shear blade is positioned so as to trim a third trim margin TM3 from the book and to thereby form a book with three trimmed edges with the book having an accurate, predetermined size. After trimming, the shear carriage is moved to its retracted position clear of the book and the nest clamp cylinder is retracted thereby to release the book.

It will be noted that it may be preferred that rather than returning trimmer 59 to its retracted position after trimming of each edge of the book, the trim carriage may be maintained in substantially its trimming position and the book may be rotated from one position to another to trim the edges of the book. By not having to retract and to advance the trimmer between its trim and retracted positions to trim each edge of the book, the time required for the trimming position may be reduced.

The control system CONT, as shown in FIG. 12, includes the components and input/output devices, as shown in the following Table I.

TABLE I

| Component Description | Item | Number | Description | Type or Function |
|---|---|---|---|---|
| Adhesive Bath 31 Heater | Breaker | Breaker 1 | 15 Amp breaker - feeds other two breakers | |
| Computer COMP | Breaker | Breaker 2 | 10 Amp breaker - from Breaker 1 | |
| Remaining Electronics | Breaker | Breaker 3 | 10 Amp breaker - from Breaker 1 | |
| Jogger Vibrator Coil 17 | Opto Relay | O-0 | 24 V Output | |

TABLE I-continued

| Component Description | Item | Number | Description | Type or Function |
|---|---|---|---|---|
| Carriage Clamp Motor M2 (close) | Opto Relay | O-1 | 24 V | |
| | 110 V Relay | R1 | Driven by O-1 | SPST |
| Carriage Clamp Motor M2 (open) | Opto Relay | O-2 | 24 V 110 V Output | |
| | 110 V Relay | R2 | Driven by O-2 | SPST |
| Mill Motor M4 | Opto Relay | O-3 | 24 V 110 V Output | |
| | 110 V Relay | R3 | Driven by O-3 | SPST |
| Debris Vacuum Motor M3 | Opto Relay | O-4 | 24 V 110 V Output | |
| | 110 V Relay | R4 | Driven by O-4 | SPST |
| Adhesive Applicator Roller 33 Motor M5 | Opto Relay | O-5 | Drives motor direct | |
| Table Up | Opto Relay | O-6 | 24 V 110 V Output | |
| Binding Clamp Lift Hydraulic Pump/ Motor PM4 (raise) | 110 V Relay | R5 | Driven by O-6 | SPST |
| Binding Clamp Lift Hydraulic Pump/ Motor PM4 (lower) | Opto Relay | O-7 | 24 V 110 V Output | |
| | 110 V Relay | R6 | Driven by O-7 | |
| | 110 V Relay | R7 | Driven by O-7 | DPDT - Reverse |
| Binding Clamp Actuator Motor M6 (close) | Opto Relay | O-8 | 24 V 110 V Output | |
| | 110 V Relay | R8 | Driven by O-8 | SPST |
| Binding Clamp Actuator Motor M6 (open) | Spring Release | | | |
| Book Nest Clamp Hydraulic Pump Motor PM3 (open) | Opto Relay | O-9 | 24 V 110 V Output | |
| | 110 V Relay | R9 | Driven by O-9 | SPST |
| Book Nest Clamp Hydraulic Pump Motor PM3 (close) | Opto Relay | O-10 | 24 V 110 V Output | |
| | 110 V Relay | R10 | Driven by O-10 | SPST |
| | 110 V Relay | R11 | Driven by O-10 | DPDT - Reverse |
| Shear Clamp Hydraulic Pump Motor PM2 (close) | Opto Relay | O-11 | 24 V 110 V Output | |
| | 110 V Relay | R12 | Driven by O-11 | SPST |
| Shear Clamp Hydraulic Pump Motor PM2 (open) | Opto Relay | O-12 | 24 V 110 V Output | |
| | 110 V Relay | R13 | Driven by O-12 | SPST |
| | 110 V Relay | R14 | Driven by O-12 | DPDT - Reverse |
| Shear Blade Hydraulic Pump Motor PM1 (close) | Opto Relay | O-13 | 24 V 110 V Output | |
| | 110 V Relay | R15 | Driven by O-13 | SPST |
| Shear Blade Hydraulic Pump Motor PM1 (open) | Opto Relay | O-14 | 24 V 110 V Output | |
| | 110 V Relay | R16 | Driven by O-14 | SPST |
| | 110 V Relay | R17 | Driven by O-14 | DPDT |
| Delivery Conveyor Limit | Opto Relay | O-15 | 24 V 110 V Output | Drive Motor Direct |
| Knife Up Limit | Opto Input | I-0 | 3-24 V | |
| | Micro Switch | SW1 | Sinks I-0 fed by 10K Ohm Resistor | |
| Knife Down Pressure Limit | Opto Input | I-1 | 3-24 V | |

TABLE I-continued

| Component Description | Item | Number | Description | Type or Function |
|---|---|---|---|---|
| | Pressure Switch | PS1 | Sinks I-1 fed by 10K Ohm Resistor | |
| Clamp Up Limit | Opto Input | I-2 | 3-24 V | |
| | Micro Switch | SW2 | Sinks I-2 fed by 10K Ohm Resistor | |
| Clamp Down Pressure Limit | Opto Input | I-3 | 3-24 V | |
| | Pressure Switch | PS2 | Sinks I-3 fed by 10K Ohm Resistor | |
| Nest Clamp Out | Opto Input | I-4 | 3-24 V | |
| | Micro Switch | SW3 | Sinks I-4 fed by 10K Ohm Resistor | |
| Nest Clamp In | Opto Input | I-5 | 3-24 V | |
| | Pressure Switch | PS3 | Sinks I-5 fed by 10K Ohm Resistor | |
| Table Up Limit | Opto Input | I-6 | 3-24 V | |
| | Pressure Switch | PS4 | Sinks I-6 fed by 10K Ohm Resistor | |
| Table Down Limit | Opto Input | I-7 | 3-24 V | |
| | Limit Switch | SW4 | Sinks I-7 fed by 10K Ohm Resistor | |
| Carriage 5 Stepper Motor M1 | 750 OEM Drive | 750-1 | | |
| Nest Elevator Stepper Motor M7 | 750 OEM Drive | 750-2 | | |
| Shear Carriage 61 Stepper Motor M8 | 750 OEM Drive | 750-3 | | |
| Nest Index Stepper Motor M9 | 750 OEM Drive | 750-4 | | |

The operation of the binder/trimmer 1 is perhaps best understood by referring to the Control Program Flow, below. It will be understood by those skilled in the art that the operational steps shown in the program flow may be used to program the control system CONT, as shown in FIG. 12.

As noted, an important provision of the binder/trimmer 1 of the present invention is that the binder/trimmer can readily accommodate books of different sizes and formats within a limited range. Upon binding a book, information concerning the number of pages of the book block, the thickness of the paper (i.e., how many pages/inch of thickness), the size of the stock of the pages P of the book block BB, the size of the cover stock C, and the desired size of the trimmed book are fed into computer COMP. Specifically, certain of the above book parameters are as follows:

$T_1$=width of cover C $T_2$=offset distance from the top edge of the book block BB to the top edge of cover C.

$T_3$=the length of the first trim cut, as measured from the top edge of cover C.

$T_4$=the final width cut, as measured from the outer edge of spine S to the major edge of the finished book B.

$T_5$=the length of the final height cut.

CONTROL PROGRAM FLOW (Basic Steps)

1. Input book parameters (e.g., number of pages, paper thickness, and dimensions) of book to be printed into computer COMP
2. Using the dimensions $T_1$–$T_5$, as above described, the trim margins TM1–TM3 are determined.
3. Determine position of cover at binding station BS such that cover is centered with respect to book block spine.
4. Energize and deenergize Jogger Coil 17 for a time sufficient to jog pages P (about 1–3 seconds).

5. Establish reference location of trailing edge of book block BB in contact with vertical carriage wall 21.
6. Energize Carriage Clamp Motor M2 to close carriage clamps 11*a*, 11*b*.
7. Wait 5 seconds, and then energize motors M3–M5.
8. Energize Carriage Stepper Motor M1 to drive carriage 7 from Jogging Station JS to Mill Station MS.
9. Deenergize Carriage Stepper motor M1 so as to stop carriage at binding station BS with book block positioned over center of cover.
10. Energize pump PM4 to raise binding clamp 35.
11. Energize clamp motor M6 to clamp cover on book block.
12. Energize clamp motor M6 to release book.
13. Reverse operation of pump PM4 to lower binding clamp 35.
14. Energize carriage stepper motor M1 to convey carriage from binding station BS to trim station TS.
15. Energize nest elevator motor M6 to raise nest elevator.
16. Energize carriage clamp motor M2 to drop book.
17. Energize carriage stepper motor M1 to nudge book to predetermined position within nest 41 such that first edge of book is accurately position with respect to nest 41.
18. Energize pump PM3 to actuate nest clamp 57.
19. Energize nest elevator stepper motor to lower nest to predetermined elevation.
20. Energize trim carriage 61 stepper motor M9 to move trimmer 59 toward first edge of book to be trimmed ($T_3$).
21. Deenergize motor M9 to stop trimmer 59 so as to trim first trim margin TM1 from book.
22. Energize Pump PM2 to close shear clamp 67.
23. Energize Pump PM1 to close trimmer blade 64.
24. Reverse operation of Pump PM1 to open trimmer blade 64.
25. Reverse operation of Pump PM2 to open shear clamp 67.
26. Energize trimmer carriage stepper motor M9 to move trimmer carriage clear of book.
27. Energize book indexing stepper motor M9 to rotate book in nest 41 90° so as to position a second edge of book to be trimmed. ($T_4$).
28. Energize trim carriage 61 stepper motor M9 to move trimmer 59 toward second edge of book to be trimmed.
29. Deenergize motor M9 to stop trimmer 59 so as to trim second trim margin TM1 from book.
30. Energize Pump PM2 to close shear clamp 67.
31. Energize Pump PM1 to close trimmer blade and to trim second edge.
32. Reverse operation of Pump PM1 to open trimmer blade.
33. Reverse operation of Pump PM2 to open shear clamp 67.
34. Energize trimmer carriage stepper motor M9 to move timmer carriage clear of book.
35. Energize book indexing stepper motor M9 to rotate book in nest 41 90° so as to orient third edge of book to be trimmed toward trimmer.
36. Energize trim carriage 61 stepper motor M9 to move trimmer 59 toward third edge of book to be trimmed.
37. Deenergize motor M9 to stop trimmer 59 so as to trim third trim margin TM1 from book so as to trim book to final height ($T_5$).
38. Energize Pump PM2 to close shear clamp 67.
39. Energize Pump PM1 to close trimmer blade and to trim third edge.
40. Reverse operation of Pump PM1 to open trimmer blade.
41. Reverse operation of Pump PM2 to open shear clamp 67.
42. Energize trimmer carriage stepper motor M9 to move trimmer carriage clear of book.
43. Energize Pump PM to open book clamp 57 and to release book.

It will be appreciated by those skilled in the art that the above operation program may be varied such that it is not necessary to fully retract trim carriage 61 after each cut of the book, but rather the trim carriage may be advanced as the book nest 41 descends on elevator 43 such that a portion of book B extending out beyond nest 41 toward trimmer 61 is received in the opening of the trimmer this guiding the cover and the pages of the book into the trimmer. After the first trim margin TM1 has been cut, the trim carriage need only retract a short distance such that the cover C and the book block BB are maintained within the opening of the trimmer. Then as indexing motor M9 is energized to rotate the book to trim the second trim margin TM2, the cover and the pages are already within the trimmer this obviating the need for a complicated guide to insure that the book cover and the book are properly received within the trimmer without bending the cover or the pages. It will be appreciated that the book nest may need to be raised or lowered with respect to the trimmer, depending on the dimensions of book B being trimmed, to insure that there is adequate clearance to rotate the book B within is indexing circle, as shown in dotted lines in FIGS. 2, 4 and 6. Likewise, a portion of book B may remain within the trimmer as the book is rotated to trim the third trim margin TM3.

In view of the above, it will be seen that the several objects and features of this invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for binding a book block and a cover to manufacture a perfect bound book and for trimming said perfect bound book to a predetermined size, said book block having a plurality of pages and ranging between a predetermined minimum and a predetermined maximum thickness, one edge of book block constituting a spine, said apparatus comprising a carriage movable along a work path, said carriage receiving said book block, said work path having an adhesive application station, a binding station, and a trimming station located therealong, said carriage being movable along said work path to said adhesive application station where a suitable adhesive is applied to said spine, said carriage then transporting said book block to said binding station where said cover is positioned such that said book block and said cover are positioned in predetermined positions with respect to one another, said binding station having a clamp that engages said cover proximate said spine and that forcefully compresses said cover onto said book block proximate said spine thereby to adhere said cover to said spine of book, said carriage further transporting said bound book to said trimming station, said trimming station having a nest for receiving said book from said carriage with said book being in a predetermined position with respect to said nest, said trimming station having a selectively operable trimming blade for trimming the margins said cover and of said book block, said nest and said trimming blade being movable with respect to one another so as to position said book with respect to said trimming blade such that upon actuation of said trimming blade a predetermined amount of said mar&gin along a first edge of said book is trimmed therefrom, said trimming station having a book indexer operable after said first edge has been trimmed so as to position a second edge of said book relative to said blade so that upon actuation of said trimming blade a predetermined amount may be trimmed from said second edge of said book, said indexer being operable after said second edge is trimmed so as to position a third edge of said book relative to said blade, said book and said trimming blade being movable relative to one another so that upon actuation of said trimming blade a predetermined amount of said margin along said third edge may be trimmed from said book so as to produce said book of said predetermined size.

2. Apparatus for binding a book block and a soft cover to manufacture a perfect bound book and for trimming said perfect bound book to a predetermined size, said book comprising a book block having a plurality of pages and a cover, said book block ranging between a minimum and a maximum number of pages, each said page being generally rectangular, one edge of said book block constituting a spine, said apparatus comprising a carriage movable along a work path, said carriage receiving said pages constituting said book block with said pages oriented such that a lowermost edge of said book block constitutes said spine, said carriage having a vertical wall against which a vertical edge of said book block bears thereby establishing a reference position for said book block with respect to said carriage, said work path having an adhesive application station, a clamping station, and a trimming station located therealong, said carriage transporting said book block to said adhesive application station where a suitable adhesive is applied to said spine, said carriage then transporting said book block to said clamping station where a cover for said book to be bound is positioned such that upon stopping of said carriage at said clamping station results in said book block and said cover being in a desired position with respect to one another, said clamping station having a clamp which engages said cover proximate said spine and forcefully compresses said cover onto said front and back faces of said book block proximate said spine thereby to adhere said cover to said book block, said carriage further transporting said bound book to said trimming station and placing said bound book in a predetermined position at said trimming station, said trimming station having a selectively actuable trimming blade for trimming predetermined amounts from said cover and said book block along one or more edges thereof, said trimming station and said blade being positionable with respect to one another such that actuation of said trimming blade a predetermined amount of the margin along a first edge is trimmed therefrom, said trimming station effecting turning of said book approximately 90° so that a second edge of said book is disposed toward said trimming blade said book and said trimming blade being positionable with respect to one another such that upon actuation of said trimming blade a predetermined amount of said book block and of said cover is trimmed from said second edge of the book, said trimming station effecting turning of said book approximately 90° so that a third edge of said book is disposed toward said trimming blade such that upon actuation of said trimming blade a predetermined amount of said book block and of said cover is trimmed from said third edge of the book, whereby a perfect bound book is produced trimmed along three edges of the book and with the book being of a predetermined size.

3. Apparatus for binding a perfect bound book and for trimming at least two sides of said book, the latter comprising a generally rectangular book block having a multiplicity of pages with the book block ranging between a minimum predetermined thickness and a maximum predetermined thickness, said book block having a front face, a back face and a spine along one of the edges of the book block, a cover having a front and back and a center section therebetween, said cover being sized relative to said book block such that the front and back of the cover overlies the front and back faces of said book block and such that said center section extends around said spine, said book block and said cover being dimensioned such that portions of said cover and of said book block are to be trimmed along one or more edges of said book thereby to result in a finished book having a predetermined rectangular size, said apparatus comprising:

a carriage for holding a book block to be bound in a cover, said carriage being movable along a work path between a plurality of work stations;

a programmable control system for controlling operation of said carriage and of said work stations along said work path, said carriage establishing a reference position for said book block carried thereby with said reference position being known to said control system;

an adhesive application station along said work path at which an adhesive suitable for bonding said cover to said spine of said book block is applied;

a clamping station along said work path at which said book block carried by said carriage and one of said covers are positioned in predetermined relation to one another, said control system effecting operation of a clamp so as to firmly clamp said cover to said book block proximate said spine such that the front and back of said cover overlies the front and back faces of said book block and such that the center section of the cover is substantially in register with said spine of said book block with said adhesive disposed between said spine and said center section of said cover thereby to bind said cover to said book block and thereby to form a bound book;

said bound book having margins along at least two edges thereof to be trimmed thereby to form said finished book with the amount of said margins to be trimmed being known to said control system; and a trimming station which receives said bound book, said trimming station having a nest for receiving said book from said carriage with the position of the book in the nest being known to said control system, said trimming station having a trimming blade movable under the control of said control system relative to said book between a retracted position in which an edge of said book to be trimmed can be positioned relative to said blade and a trimming position in which said blade may be actuated to trim a predetermined amount of said margin known to said control system from said one edge of said book, said control system effecting the positioning of said book relative to said blade so that upon actuation of said blade a predetermined amount of said margin along a second edge of said book known to said control system is trimmed from along said second edge.

4. Apparatus as set forth in claim 3 wherein, after trimming of said second edge of said book, said control system effecting the positioning of said book so that a third edge of said book is positioned relative to said trimming blade so that upon movement of said trimming blade from its retracted to its trimming position a predetermined amount of the margin along said third edge is trimmed from said third edge of said book.

5. Apparatus as set forth in claim 1, 2, or 3 further comprising a jogging station along said work path, said jogging station vibrating said pages of said book block so as to substantially align the pages relative to one another.

6. Apparatus as set forth in claim 1, 2, or 3 further comprising a milling station along said work path where at said milling station said spine is conditioned to facilitate the adhesive binding of the pages to the cover in the area of said spine.

7. Apparatus as set forth in claims 1 or 2 wherein said adhesive is a heat activatable adhesive, and wherein said binding station includes an ultrasonic horn engageable with the exterior surface of said center portion of said cover for activating said adhesive to thereby effect binding of said cover to said book block.

8. Apparatus as set forth in claim 1 or 2 further comprising a controller for effecting movement of said carriage along said work path from one station to another therealong and for effecting operation of said adhesive application station, said binding or clamping station, and said trimming station.

9. Apparatus for binding a book block and a cover to manufacture a perfect bound book and for trimming said perfect bound book to a predetermined size, said book block having a plurality of pages and ranging between a minimum and a maximum number of pages, one edge of book block constituting a spine, said apparatus comprising:

a programmable control system for controlling said apparatus, said programmable control system receiving information relating to the size of the book to be bound and controlling operation of said apparatus so as to bind said book block and cover to form a bound book and to trim predetermined amounts from the margins from said bound book to produce said book of said predetermined size;

a carriage under the control of said control system movable along a work path, said carriage receiving said book block with said with said book block being in a reference position relative to said carriage known to said control system;

said work path having an adhesive application station, a clamping station and a trimming station located therealong;

said control system initiating movement of said carriage along said work path past said adhesive application station where a suitable adhesive is applied so as to be between said spine and said cover upon binding of the cover to said book block;

at said clamping station, said control system positioning said cover and said book block in predetermined relation, said clamping station having clamping members disposed on opposite sides of said book block and engageable with said cover proximate said spine so as to forcefully compress said cover onto said book block proximate said spine thereby to adhere said cover to said spine so as to form a bound book;

said control system then effecting movement of said carriage along said work path so as to transport said bound book to said trimming station, said bound book have excess margins known to said control system, the latter effecting operation of a selectively actuable trimming blade at said trimming station for trimming said excess margins so as to produce said bound book of said predetermined size.

10. Apparatus for binding a book block and a soft cover to manufacture a perfect bound book and for trimming said perfect bound book to a predetermined size, said book comprising a book block having a plurality of pages and a cover, said book block ranging between a predetermined minimum and a predetermined maximum thickness, one edge of book block constituting a spine, said apparatus comprising:

a carriage movable along a work path, said carriage receiving said book block with said pages oriented in a vertical plane;

said work path having an adhesive application station, a binding station, and a trimming station located therealong;

said carriage being movable along said work path to said adhesive application station where a suitable adhesive is applied to said spine of said book block;

said carriage then transporting said book block to said binding station where said cover for said book is positioned such that upon stopping of said carriage at said binding station said spine of said book block is positioned substantially in register with said cover;

said binding station having a clamp that engages said cover proximate said spine and that forcefully compresses said cover onto said front and back faces of said book block proximate said spine thereby to adhere said cover to said spine of said book block;

said carriage further transporting said bound book to said trimming station, said carriage placing said book in said trimming station at a predetermined position, said trimming station having a selective operable trimming blade for trimming predetermined amounts of said cover and of said book block along first, second, and third edges thereof, said trimming station having a book indexer for rotating said book so as to present said second edge and then said third edge of said book toward said trimming blade after said first edge has been trimmed, said book and said trimming blade being adjustably movable relative to one another in response to said predetermined size of said book so as to position the trimming blade with respect to the first, second, and third edges of the book so that said predetermined amounts of said cover and of said book block may be trimmed therefrom such that said book of said predetermined size will be produced.

11. A method of manufacturing a perfect bound book wherein a book block is bound to a cover and predetermined amounts of said cover and of said book block are trimmed from along first, second and/or third edges of said book to as to produce a book of a predetermined size, said book block having a plurality of pages, said method comprising the steps of:

(a) moving said book block along a work path from an adhesive application station, to a binding station, and thence to a trimming station;

(b) knowing the position of said book block as the latter is moved along said work path;

(c) with said book block at said adhesive application station, depositing adhesive so as to be disposed between one edge of said book block and said cover, said one edge constituting the spine of said book block;

(d) with said book block at said binding station, clamping said cover onto said book block proximate said spine and effecting an adhesive bond between said cover and said spine of said book block;

(e) positioning said book in a predetermined position within said trimming station; and (f) trimming a predetermined amount from the margin of said book along a first edge thereof, (1) then turning said book and trimming a predetermined amount from the margin of said book along a second edge thereof, and (2) then turning said book and trimming a predetermined amount from the margin of said book along a third edge thereof so as to produce a bound book trimmed along three edges to said predetermined size.

12. The method as set forth in claim 11 wherein said adhesive is a heat activatable adhesive, and wherein said binding station includes an ultrasonic horn, said step of effecting adhesive bonding between said spine of said book block and said cover is effected by bringing said ultrasonic horn in working engagement with the outer surface of the portion of said cover proximate said spine and rendering said ultrasonic horn resonant thereby to transmit ultrasonic energy to said adhesive so as to at least partially melt said adhesive and to thereby effect said adhesive bonding between said spine and said cover.

13. Apparatus as set forth in claim 9 wherein said trimming station has a nest for receiving said book from said carriage, said carriage positioning said book in said nest in a position known to said control system, said trimming station having a book indexer under the control of said control system for rotating said book after a first edges has been trimmed so as to dispose said second edge of said book toward said blade, said control system effecting the positioning said second edge of said book and said blade relative to one another so that upon actuation of said blade a predetermined amount of said margin along said second edge is trimmed from the book.

14. Apparatus as set forth in claim 13 wherein said indexer under the control of said control system rotates said book so as dispose a third edge of said book toward said blade, said control system effecting the positioning of said second edge of said book and said blade relative to one another so that upon actuation of said blade a predetermined amount of said margin along said third edge is trimmed from said book.

15. Apparatus as set forth in claim 9 wherein said adhesive application station applies a heat activatable adhesive, and wherein said binding station includes an ultrasonic tool operatively engageable with the exterior of the cover along the spine such that when said ultrasonic tool is rendered resonant, ultrasonic energy is transmitted through said cover and activates said adhesive thereby bind said cover to said book block.

16. Apparatus as set forth in claim 9 further including a jogging station along said work path prior to said adhesive application station, whereby at said jogging station the pages of said book block are loosely held by said carriage, said jogging station vibrationally moving the pages of said book block generally into register with one another.

17. Apparatus as set forth in claim 16 wherein said jogging station positions said pages of said book block in said reference position.

18. Apparatus as set forth in claim 9 further including a milling station along said work path, said milling station preparing the spine of said book block for receiving said adhesive.

19. Apparatus as set forth in claim 9 wherein said trimming station has a clamp for holding said book while said edges are trimmed, said carriage, under the control of said control system, positioning said book in said trimming station clamp so that said book is in a predetermined position at said trimming station so as to trim said predetermined amounts of said excess margins from said cover and from said book block.

20. The method as set forth in claim 11 wherein said step of trimming said predetermined amounts from the margins utilizes a trimming blade, and wherein said method further comprises positioning said book relative to said trimming blade so as to trim said predetermined amounts from the margins of said book.

21. The method as set forth in claim 11 wherein said trimming step uses a trimming blade assembly having an opening for said book, and wherein said step of trimming said predetermined amounts of said margins from said book includes guiding the pages of said book block and said cover into said trimming blade opening and maintaining said book block and said cover within said trimming blade opening as said book is turned to trim said margins.

22. A method of manufacturing a bound book wherein a book block is bound to a cover and wherein predetermined amounts of said cover and of said book block are trimmed from along first, second and third edges of said book to as to produce a finished book of a predetermined size, said book block having a plurality of pages, said method comprising the steps of:

a. establishing a reference position of said book block known to a computer control system;

b. under the control of said computer control system, effecting movement of said book block along a work path having an adhesive application station, a binding station, and a trimming station therealong;

c. wherein with said book block at said adhesive application station, applying adhesive so as to be disposed between one edge of said book block and said cover, said one edge constituting the spine of said book block;

d. under the control of said computer control system, at said binding station, positioning said book block with respect to said cover such that said book block and said cover are positioned with respect to one another in a predetermined position known to said computer control system;

e. wherein at said binding station, clamping said cover onto said book block proximate said spine and effecting an adhesive bond between said cover and said spine of said book block such that said spine is adhesively bound to said cover and such that the pages of said book block are adhesively bound to one another proximate said spine;

f. wherein upon the binding of the book, said book having excess margins along three edges thereof to be trimmed from said book, said computer control system knowing the amount of said margins to be trimmed from each edge of said book; and g. wherein with said book at said trimming station, under the control of said computer control system, effecting trimming of said excess margin along a first edge of said book, i. then turning said book and trimming said excess margin along a second edge of said book, and ii. then turning said book and trimming said excess margin along a third edge thereof so as to produce said finished book of said predetermined size.

* * * * *